US007063405B2

(12) United States Patent
Ito et al.

(10) Patent No.: US 7,063,405 B2
(45) **Date of Patent: *Jun. 20, 2006**

(54) INK-JET HEAD AND METHOD OF FABRICATING SAME

(75) Inventors: Atsushi Ito, Nagoya (JP); Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 89 days.

This patent is subject to a terminal disclaimer.

(21) Appl. No.: 10/784,194

(22) Filed: Feb. 24, 2004

(65) Prior Publication Data

US 2004/0165028 A1 Aug. 26, 2004

Related U.S. Application Data

(63) Continuation of application No. 09/933,156, filed on Aug. 21, 2001, now Pat. No. 6,729,717.

(30) Foreign Application Priority Data

| | | |
|---|---|---|
| Aug. 30, 2000 | (JP) | 2000-260614 |
| Aug. 30, 2000 | (JP) | 2000-260617 |
| Jan. 31, 2001 | (JP) | 2001-023776 |

(51) Int. Cl.
*B41J 2/14* (2006.01)

(52) U.S. Cl. ..... 347/47

(58) Field of Classification Search ..... 347/13, 347/14, 15, 20, 29, 40, 47, 50, 84, 87
See application file for complete search history.

(56) References Cited

U.S. PATENT DOCUMENTS

| | | | | |
|---|---|---|---|---|
| 4,680,595 | A | 7/1987 | Cruz-Uribe et al. | |
| 5,442,386 | A * | 8/1995 | Childers et al. | 347/50 |
| 5,872,583 | A | 2/1999 | Yamamoto et al. | |
| 5,874,971 | A | 2/1999 | Nishioka et al. | |
| 5,956,058 | A | 9/1999 | Momose et al. | |
| 6,027,208 | A | 2/2000 | Amano | |
| 6,053,596 | A | 4/2000 | Nakano et al. | |
| 6,168,255 | B1 * | 1/2001 | Nagashima | 347/20 |
| 6,361,155 | B1 | 3/2002 | Kanda et al. | |
| 6,631,981 | B1 | 10/2003 | Isono et al. | |
| 6,648,455 | B1 | 11/2003 | Takagi | |
| 6,729,717 | B1 * | 5/2004 | Ito et al. | 347/84 |

FOREIGN PATENT DOCUMENTS

| | | |
|---|---|---|
| JP | A 8-276586 | 10/1996 |

* cited by examiner

*Primary Examiner*—Anh T. N. Vo
(74) *Attorney, Agent, or Firm*—Oliff & Berridge, PLC

(57) ABSTRACT

A ring-shaped packing is fitted into a annular groove surrounding an aperture through which ink is supplied to a head unit, and a sealant is filled around the packing. By bringing the packing into contact with the surface of a filter covering a supply hole and by pressing the head unit, the sealant makes intimate contact with the head unit while the end of the packing is kept in intimate contact with the filter, thereby sealing the supply hole. Then a frame and the head unit are bonded to each other using an UV adhesive.

42 Claims, 20 Drawing Sheets

INK-JET HEAD AND METHOD OF FABRICATING SAME

This is a Continuation of Application Ser. No. 09/933,156 filed Aug. 21, 2001 now U.S. Pat. No. 6,729,717. The entire disclosure of the prior application is hereby incorporated by reference herein in its entirety.

BACKGROUND OF THE INVENTION

1. Field of Invention

The invention relates to the construction of an ink-jet head and a method of fabricating same.

2. Description of Related Art

An on-demand type ink-jet printer head using piezoelectric elements is disclosed in Japanese Patent Application Publication No. 8-276586. In the disclosed ink-jet head, a head unit is bonded, using an adhesive, to a head case made of a synthetic resin.

The head case is molded by injection of a synthetic resin. However, due to a fabricating error, an adhesive interposed between the head case and the head unit may be squeezed out. If the squeezed adhesive makes contact with ink to be supplied to the head unit, chemical reaction occurs. As a result, adhesive particles are dispersed into the ink and cause an ink ejection failure and ultimately clogging of the nozzle.

If the ink permeates into the adhesive, the ink may leak to the outside with the aid of air bubbles contained in the adhesive.

Another problem is that an ink-jet head is hard to fabricate with a high degree of accuracy by bonding using an adhesive. Especially, when a plurality of head units are bonded to a single head case, the mounting accuracy should be improved between the head units and the head case as well as between the head units. If such mounting accuracy is low, the direction and angle of the ink ejected from the nozzle becomes unstable, resulting in poor printing quality.

SUMMARY OF THE INVENTION

The invention addresses the forgoing problems.

In an ink-jet head according to the invention, a head unit is bonded to a frame such that an ink supply hole provided in the head unit faces an aperture of an ink supply passage formed in the frame. A groove is formed around the rim of the aperture. A packing is fitted into the groove and a sealant is filled around the packing. The packing and the sealant cooperate to seal a gap between the aperture and the supply hole.

When an ink-jet head is fabricated, the packing is brought into contact, at its end, with the backside of the head unit so as to surround the supply hole. While a gap between the aperture and the supply hole is sealed, a sealant is filled into the outer rim of the packing. The filled sealant does not enter, beyond the packing, the inner rim thereof. Accordingly, the effective area of the ink supply hole is not reduced. In addition, because ink does not contact the sealant, no chemical reaction occurs therebetween and the performance of the ink-jet head can be maintained.

By pressing the head unit and the frame relative to each other, the backing sinks into the groove while the end of the packing is kept in intimate contact with the backside of the head unit so as to surround the ink supply hole and while the inner rim face of the packing is kept in intimate contact with the inner rim wall of the groove. Such intimate contact between the end of the packing and the backside of the head unit does not permit the sealant, if it overflows the packing, to enter the inside diameter portion of the packing.

Accordingly, the sealant makes intimate contact with the head unit in the outer rim of the packing and tightly seals the supply hole.

Preferably, the head unit and the frame are bonded to each other using a quickly hardened adhesive, such as an UV adhesive to be hardened under ultraviolet irradiation. Use of a quickly hardened adhesive eliminates the need for pressing the head unit and the frame for a long time and prevents them from being deformed. In addition, the accuracy of mounting the head unit can be improved by reducing its positioning error and, as a result, print quality can be improved. Use of a quickly hardened adhesive, which is hardened in a very short time, will substantially improve efficiency of an assembling process.

Further, by simultaneously irradiating a plurality of UV adhesive-applied portions with ultraviolet light, the adhesive in the plurality of portions can be simultaneously hardened. This prevents the head unit and the frame from being distorted.

Especially, by applying the adhesive near the four corners of one head unit, a displacement of the head unit caused by contractionary distortion of the adhesive, when it is hardened, can be minimized.

Further, bonding the head unit, at its four corners, to the frame prevents the head unit from being deformed when a rubber cap is pressed against a nozzle face to perform a nozzle restoration operation.

Further, the accuracy of mounting the head unit can be improved by providing positioning holes in a nozzle plate and by fitting the nozzle plate into a jig having positioning pins corresponding to the positioning holes. Especially, when a plurality of head units are mounted side by side on the frame, not only the mounting accuracy between the head unit and the frame but also the mounting accuracy between the head units can be improved.

BRIEF DESCRIPTION OF THE DRAWINGS

A preferred embodiment of the invention will be described with reference to the following figures, wherein.

DETAILED DESCRIPTION OF PREFERRED EMBODIMENTS

U.S. patent application Ser. No. 09/897,394, now U.S. Pat. No. 6,631,981, issued Oct. 13, 2003, is incorporated herein by reference in its entirety. Additionally, U.S. application titled PIEZOELECTRIC INK-JET PRINTER HEAD AND METHOD OF FABRICATING SAME filed with the U.S. Patent and Trademark Office on the same date as the filing date of application of this invention, and now U.S. Pat. No. 6,648,455, issued Nov. 18, 2003, is incorporated by reference herein in its entirety.

Figure 1:
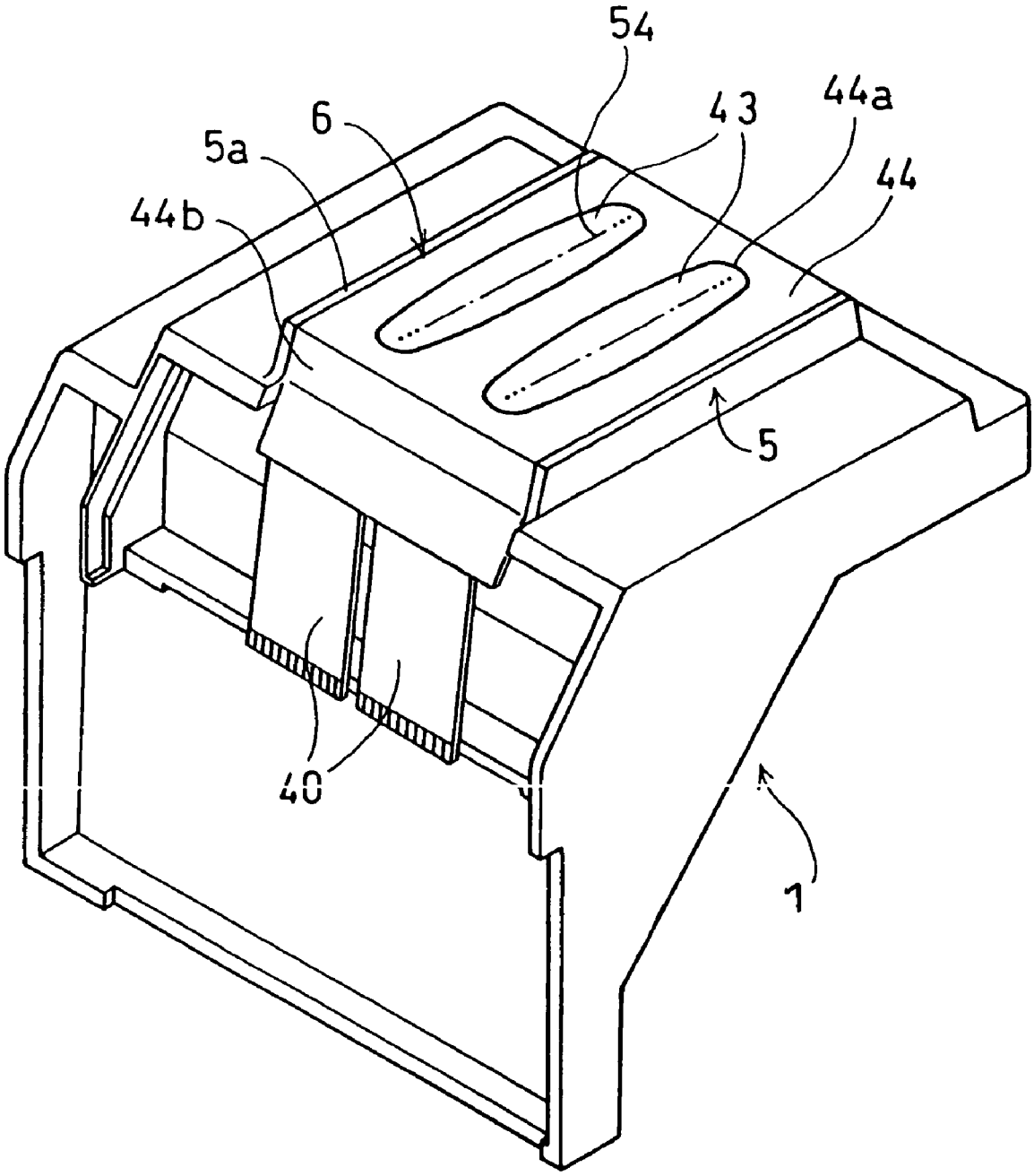
FIG. 1 is a perspective view of an ink-jet head with its nozzles facing upward.
Figure 3:
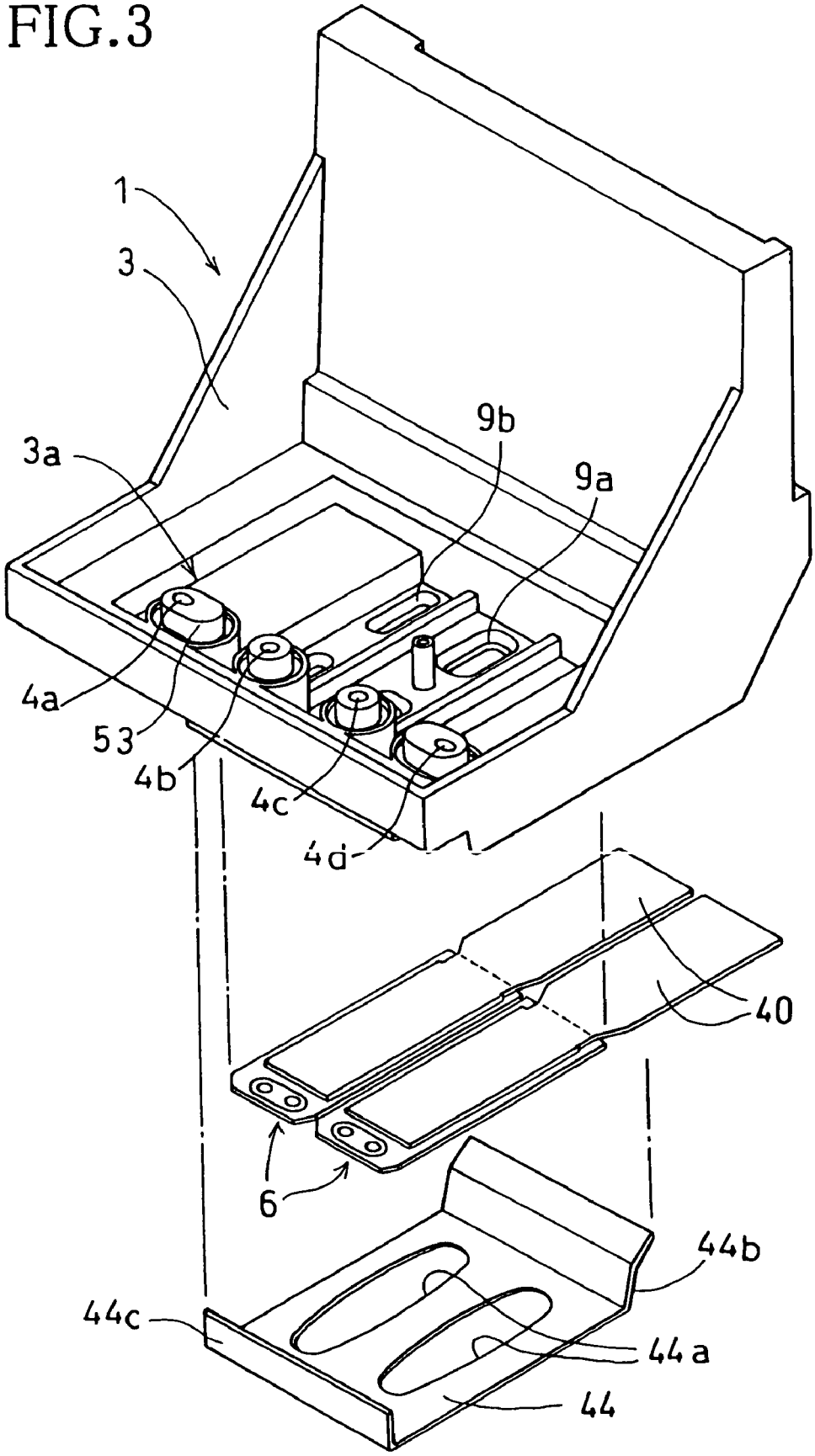
FIG. 3 is an exploded perspective view of the ink-jet head looking down from a frame.

As shown in FIG 3, a frame 1 to be mounted on a known carnage (not shown) traveling along a printing medium is molded by injection of a synthetic resin, such as polyproethylene and polypropylene, into substantially a box with its upper surface open. A mount 3 is formed in the frame 1, and four ink cartridges (not shown) for supplying ink are detachably mounted to the mount 3 from above the frame 1. On one side 3*a* of the mount 3, ink supply passages 4*a*, 4*b*, 4*c*, 4*d*, connected to ink discharge ports (not shown), are formed so as to pass through a bottom plate 5, shown in FIG. 1, of the frame 1.

Figure 2:
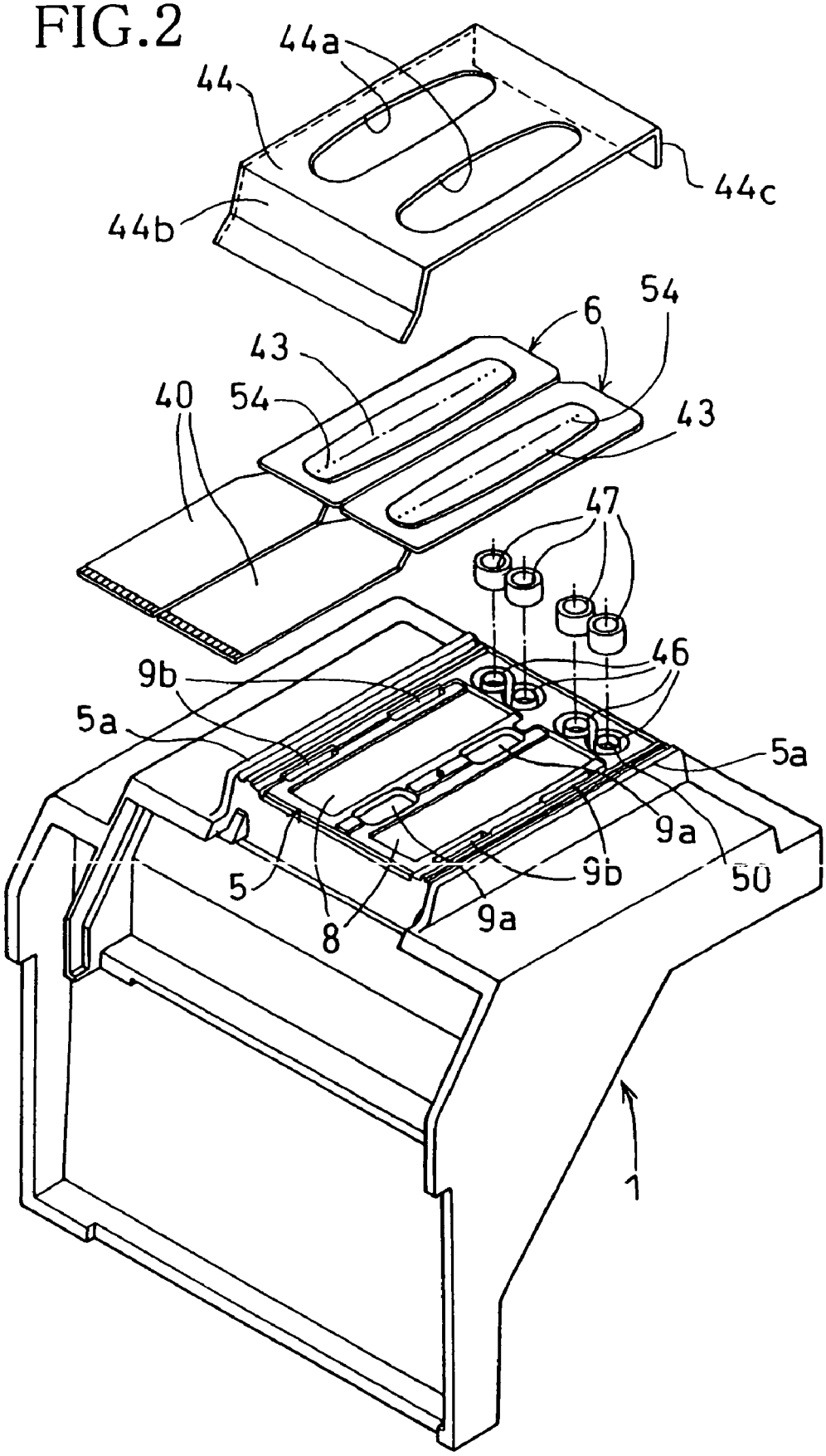
FIG. 2 is an exploded perspective view of the ink-jet head.
Figure 4:
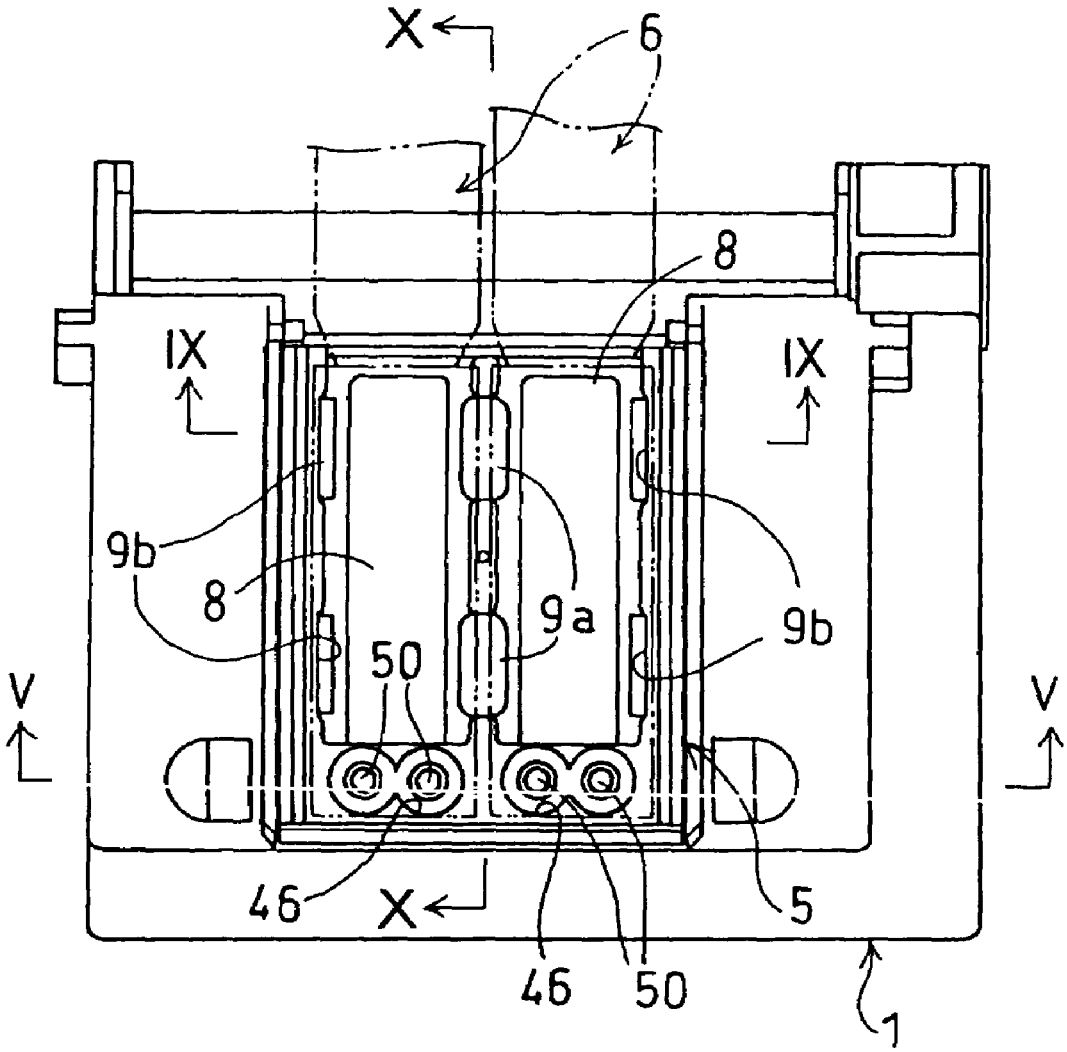
FIG. 4 is a bottom view of a bottom plate of the frame.
Figure 5:
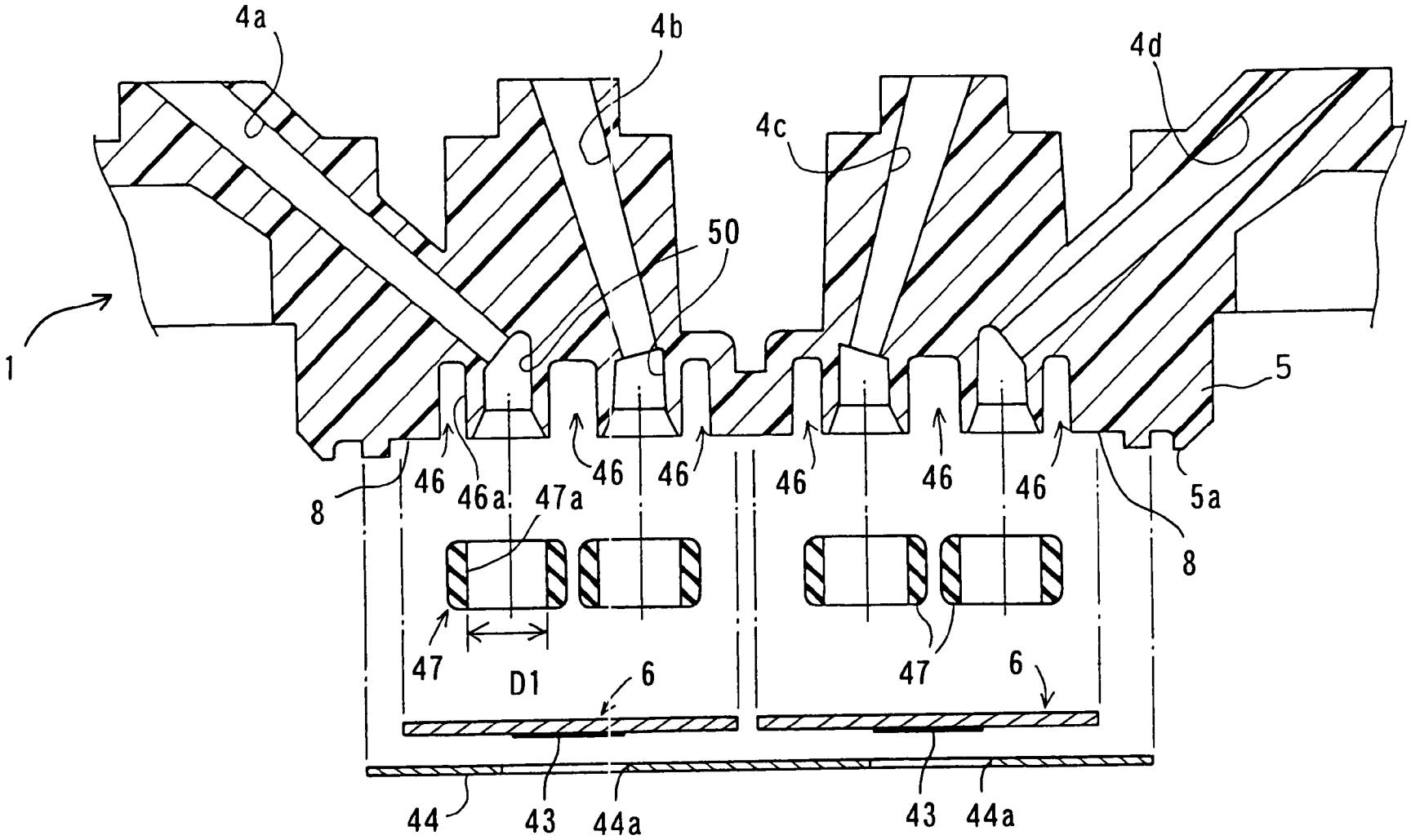
FIG. 5 is a cross-sectional view taken along line V—V of FIG. 4.

The bottom plate 5 is stepped down from the mount 3 so as to project therefrom. As shown in FIG 2, on the underside of the bottom plate 5, two stepped supports 8, 8 are formed to receive two head units 6 side by side, as will be described later. As shown in FIGS. 2, 4, and 5, four apertures 50, 50, 50, 50, which communicate with the four ink supply passages a, 4*b*, 4*c*, 4*d*, respectively, are provided adjacent to the supports 8, 8. An annular groove 46 is recessed so as to surround the outer rim of each aperture 50. As shown in FIG 4, the two adjacent annular grooves 46, 46, which have a limited space therebetween, are connected with each other into a shape of eight in the plan view.

As shown in FIGS. 2 and 5, a ring-shaped packing 47, made of soft rubber and having excellent sealing properties, is fitted into each of the annular grooves 46. The inside diameter D1 of the packing 47 is previously determined so that the inner rim face 47*a* of the packing 47 makes intimate contact with the inner rim wall 46*a* of the annular groove 46.

Figure 9:
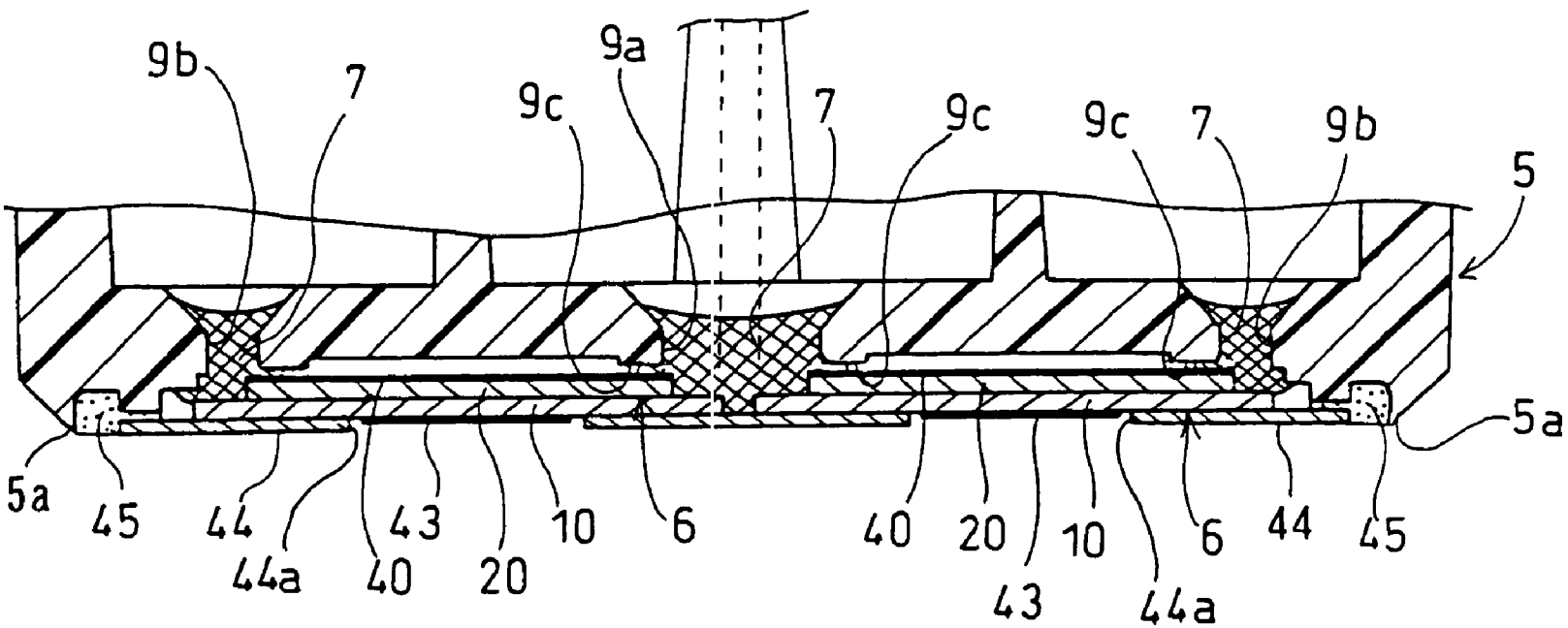
FIG. 9 is a cross-sectional view, taken along line IX—IX of FIG. 4, showing bonding between the frame and the head unit.

In the bottom plate 5, a plurality of recesses 9*a*, 9*b*, which are filled with a quickly hardened UD adhesive 7 to bond the head units 6, are formed so as to penetrate the bottom plate 5 (FIG. 9).

As shown in FIG. 4, portions near the four corners of each head unit 6 are exposed through the recesses 9*a*, 9*b*. Between the two adjacent supports 8, 8, wider recesses 9*a*, 9*a* are formed such that the backsides of the two head units 6, 6 are exposed therethrough.

As shown in FIG. 3, at the top of one side 3*a* of the mount 3, rubber packings 53 are disposed at the ink supply passages 4*a*, 4*b*, 4*c*, 4*d* so as to make the ink passages 4*a*, 4*b*, 4*c*, 4*d* intimate contact with the ink discharge ports.

Figure 13:
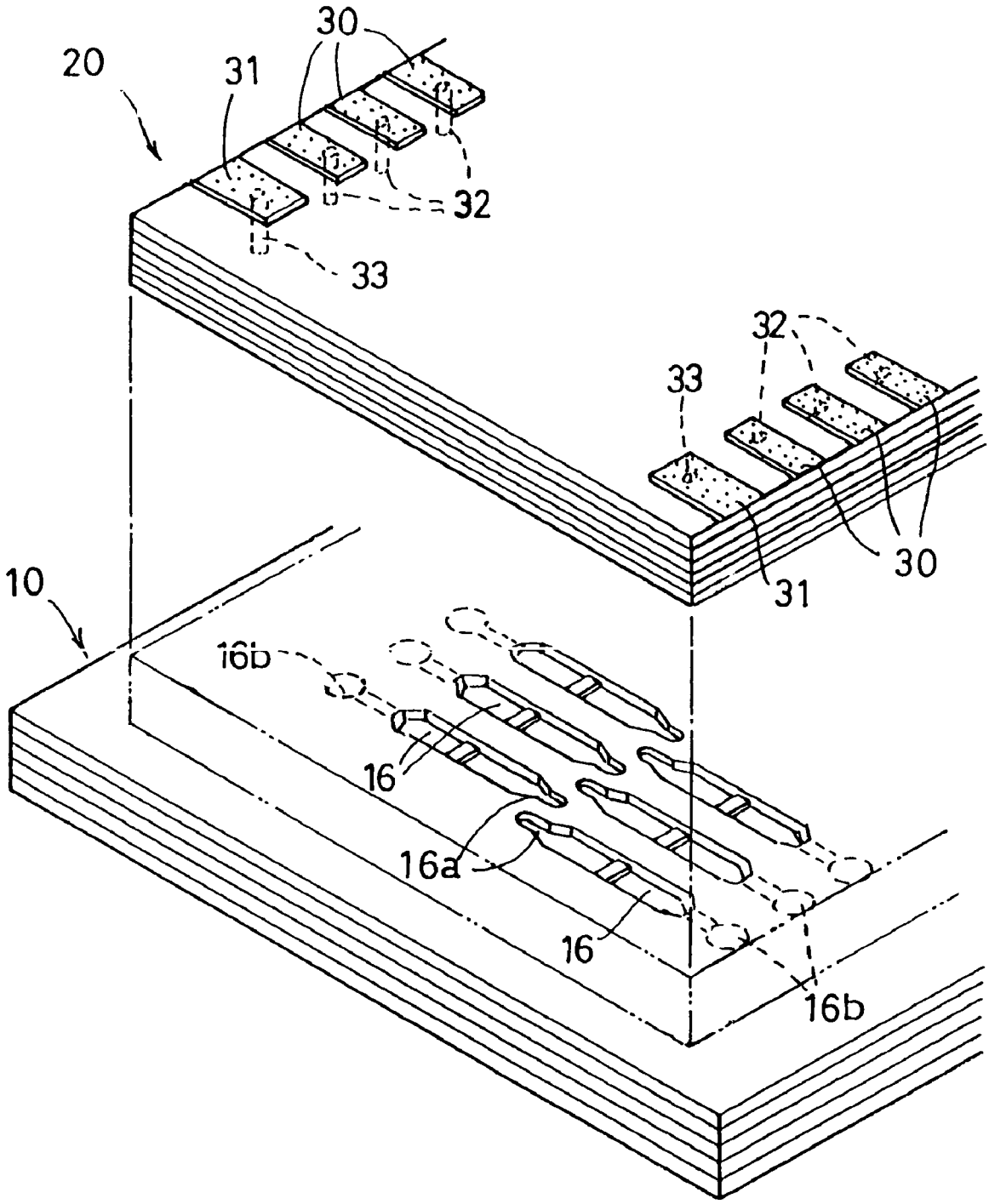
FIG. 13 is an enlarged perspective view of one end of a cavity plate and one end of a piezoelectric actuator.
Figure 17:
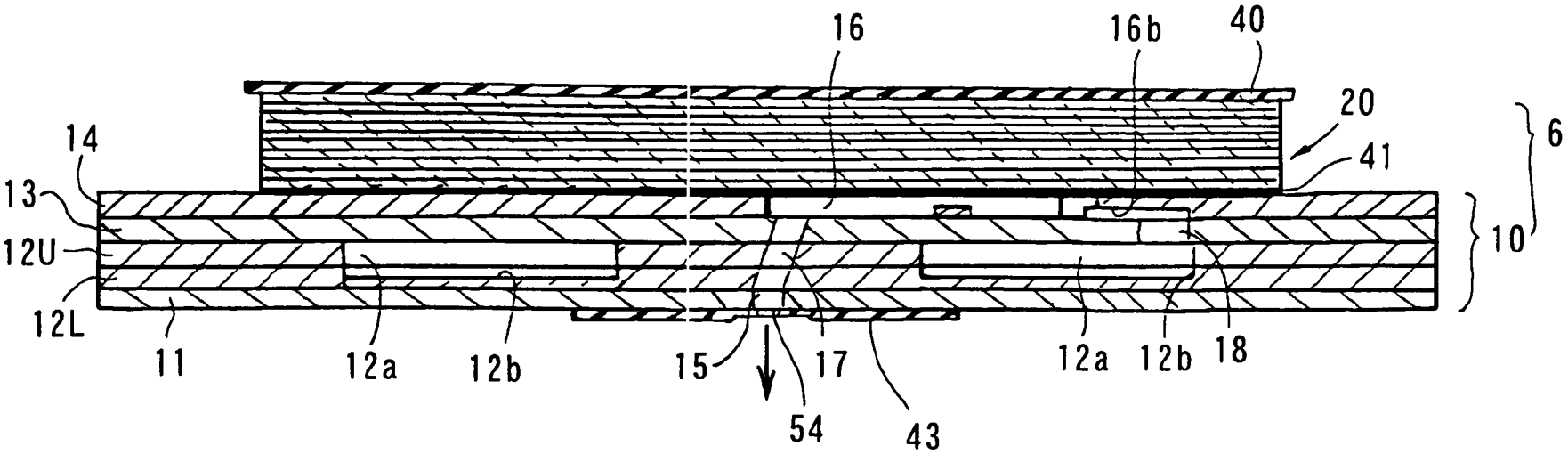
FIG. 17 is an enlarged side cross-sectional view of the head unit.

The head unit 6 has, as shown in FIG. 13, a cavity plate 10 constructed by laminating a plurality of thin metal plates and a plate-like piezoelectric actuator 20 to be bonded to the cavity plate 10 using an adhesive sheet 41 as shown in FIG. 17. A flexible flat cable 40 is bonded, using an adhesive, to the upper surface of the piezoelectric actuator 20 for electric connection with a driving circuit. Nozzles 54 are formed on the underside of the cavity plate 10 at the bottom and ink is ejected downward therefrom.

The construction of the head unit 6 will now be described in detail.

The cavity plate 10 is constructed as shown in FIGS. 12–15, and 17. Six thin metal plates, namely, a nozzle plate 43, a lower plate 11, two manifold plates 12U, 12L, a spacer plate 13, and a base plate 14, are laminated in this order using an adhesive.

Each of the plates except for the nozzle plate 43 is a steel plate alloyed with 42% nickel, about 50–150 μm thick.

In the nozzle plate 43, a number of nozzles 54 as small as about 25 μm in diameter, are provided with a small pitch of P, in two rows in a staggered configuration, along the longitudinal direction of the nozzle plate 43. In the lower plate 11, through holes 15 aligned with the nozzles 54 are provided in a staggered configuration, along two reference lines 11*a*, 11*b* parallel to the longitudinal direction.

Figure 19:
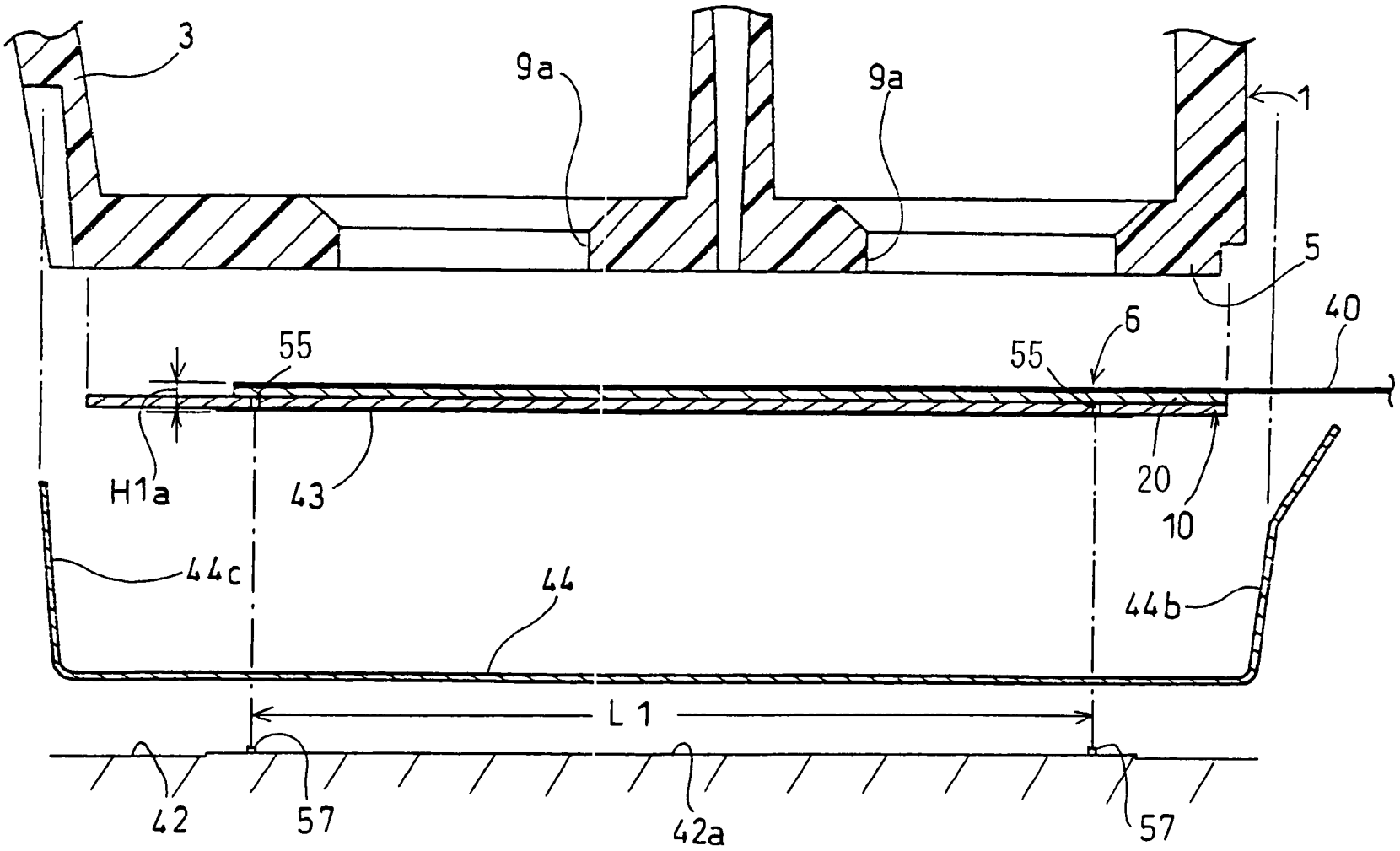
FIG. 19 is an enlarged cross-sectional view taken along line X—X of FIG. 4.

As shown in FIG. 19, in the nozzle plate 43, a pair of positioning holes 55, 55 are provided so as to be spaced a distance L1 away from each other, at or around the front and rear of the rows of nozzles 54. The positioning holes 55 are used for mounting a plurality of head units 6, 6 side by side with a high degree of accuracy, as will be described later.

The nozzles 54 and the positioning holes 55 can be simultaneously bored in a single process by punching or laser machining. Accordingly, the positioning holes 55 can be bored with a high degree of precision with reference to the straight rows of nozzles 54. In this case, the positioning error between the nozzles 54 and the positioning holes 55 can be reduced as compared with a case where the nozzles 54 and the positioning holes 55 are bored in separate processes. In addition, the positioning error introduced when a plurality of head units 6 are mounted side by side can be reduced also.

If the positioning holes 55, 55 are too close to the front and rear ends of the rows of nozzles 54, ink may enter the positioning holes 55 during printing. Thus, in this embodiment, the positioning holes 55 are bored at least 1 mm away from the nearest nozzle 54, as shown in FIG. 19.

Figure 15:
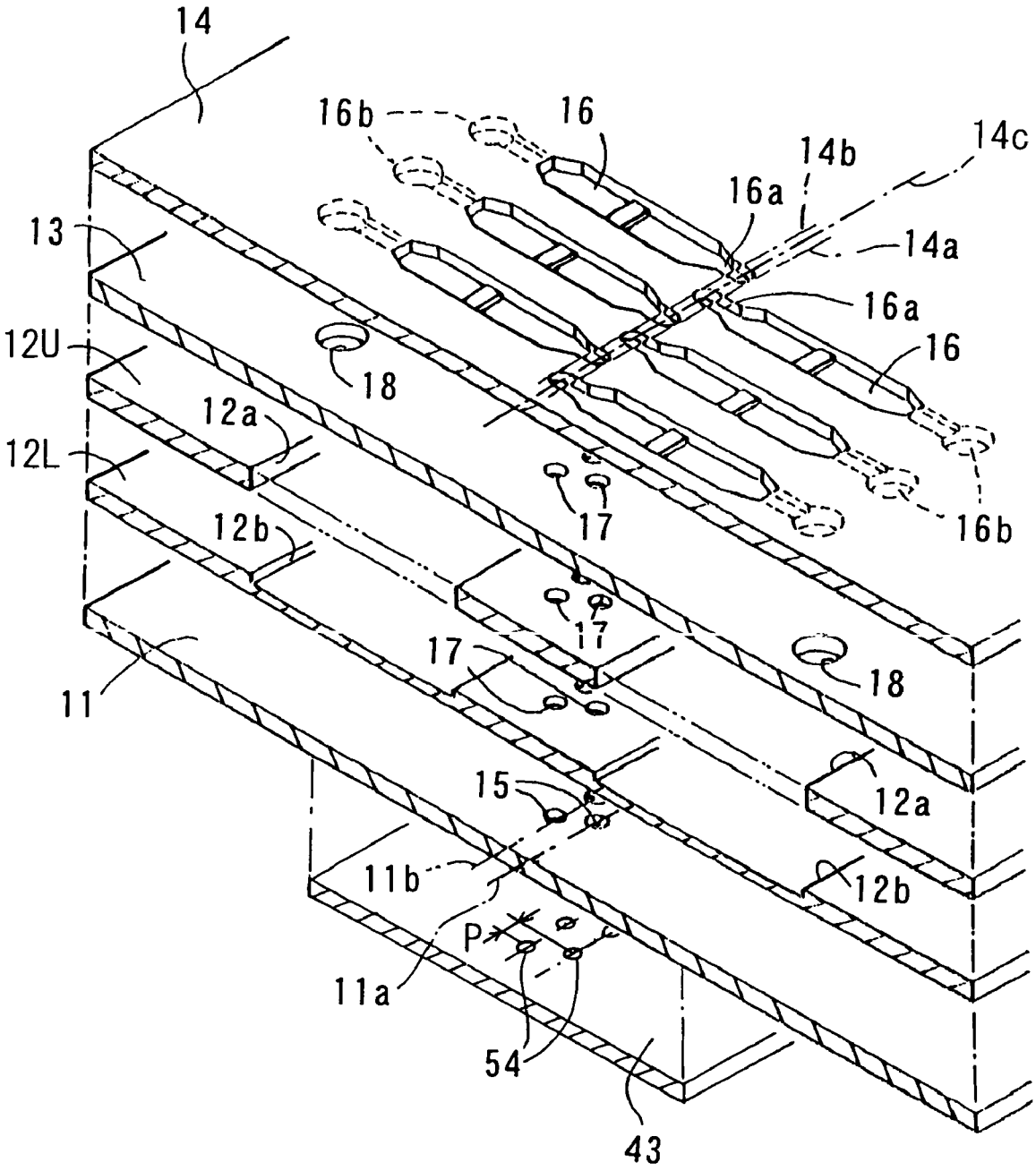
FIG. 15 is a partially enlarged perspective view of the cavity plate.

In the manifold plates 12U, 12L, ink passages 12*a*, 12*b* are provided, respectively, so as to extend along both sides of the rows of nozzles 54. As shown in FIG. 15, the ink passages 12*b* are recessed in the lower manifold plate 12L, which is contiguous to the lower plate 11, so as to be open only toward the upper side of the lower manifold plate 12L. The ink -passages 12*a* in the upper manifold plate 12U, which overlies the lower manifold plate 12L, are formed through the manifold plate 12U into the same shape as the ink passages 12*b*.

In the manifold plates 12U, 12L, through holes 17 are formed at positions to be aligned with the nozzles 15 when the manifold plates 12U, 12L are laminated to the lower plate 11.

The ink passages 12*a*, 12*b* are closed by the spacer plate 13 contiguous to the upper manifold plate 12U. Likewise, through holes 17 are formed in the spacer plate 13.

Figure 8:
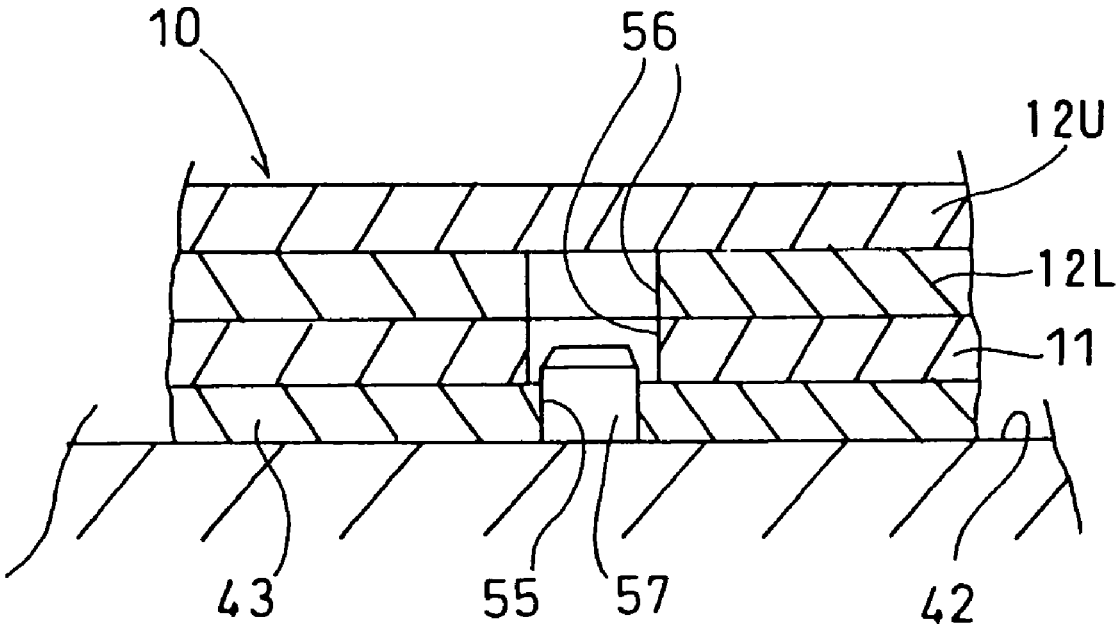
FIG. 8 is a cross-sectional view showing the positional relations among a positioning pin, a positioning hole, and an escape hole.

As shown in FIG. 8, in the lower plate 11 and the manifold plate 12L, escape holes 56 are provided so as to communicate with the positioning holes 55. The escape holes 56 are adapted to be larger, in diameter, than the positioning holes 55. No escape holes 56 are provided in the manifold plate 12U, as shown in FIG. 8. Thus, the ink entering the positioning holes 55 cannot reach the piezoelectric actuator 20 to be described later and will not develop a short circuit in the piezoelectric actuator 20.

Referring to FIG. 15, in the base plate 14, a number of narrow pressure chambers 16 are provided so as to extend laterally to the central axis 14*c* and the rows of pressure chambers are arranged parallel to the longitudinal direction. When longitudinal parallel reference lines 14*a*, 14*b* are drawn on the right and left sides of the central axis 14*c*, end passages 16*a* of the pressure chambers 16 on the right side are aligned with the left longitudinal reference line 14*b*, while end passages 16*a* of the pressure chambers 16 on the left side are aligned with the right longitudinal reference line 14*a*. The opposed end passages 16*a* of the right and left pressure chambers 16 are arranged in an interlaced relationship. Thus, the right and left pressure chambers 16 extend alternately beyond the central axis 14*c*.

The end passage 16*a* of each of the pressure chambers 16 is positioned so as to be aligned with an associated one of the nozzles 54 in the nozzle plate 43. The end passages 16*a* communicate with the spacer plate 13 and the manifold plates 12U, 12L, via the through holes 17 having a very small diameter and formed in a staggered configuration similar to the nozzles 15.

On the other hand, the other ends 16*b* of the pressure chambers 16 communicate with the ink passages 12*a*, 12*b* in the manifold plates 12U, 12L, via the through holes 18 provided on right and left side portions of the spacer plate 13. As shown in FIG. 15, the other ends 16*b* are recessed so as to be open only toward the underside of the base plate 14.

Figure 6A:
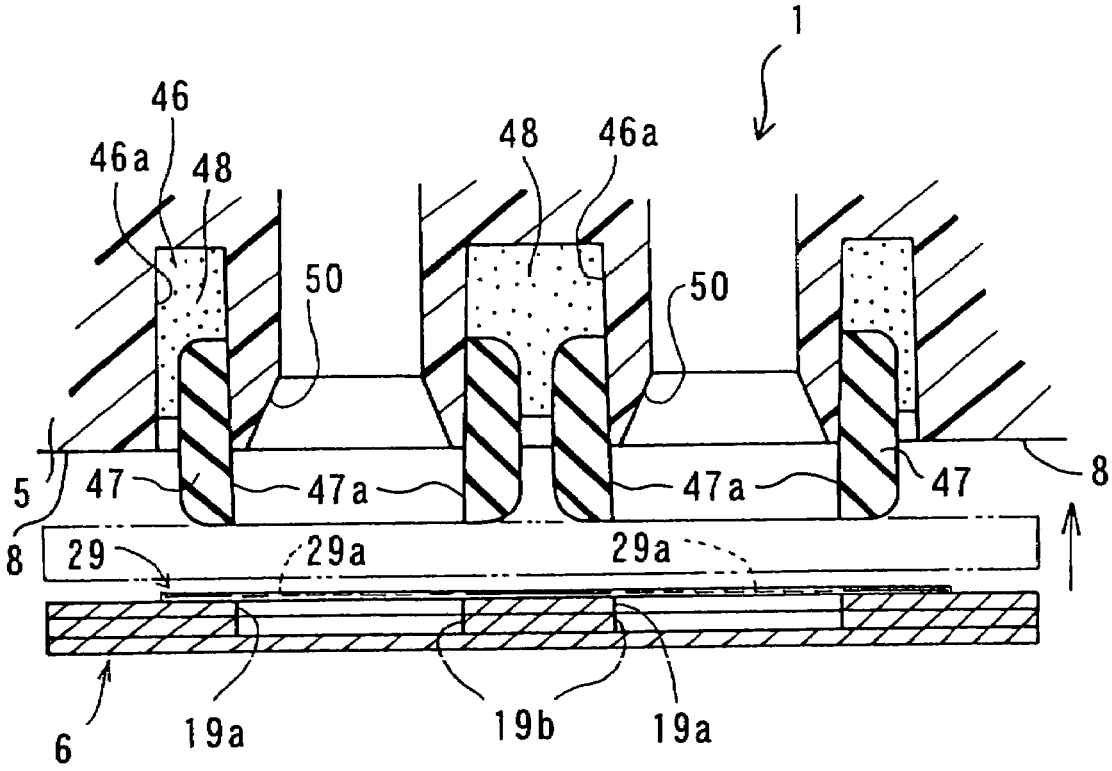
FIG. 6A illustrates a process of fitting packings into annular grooves and filling a sealant.
Figure 14:
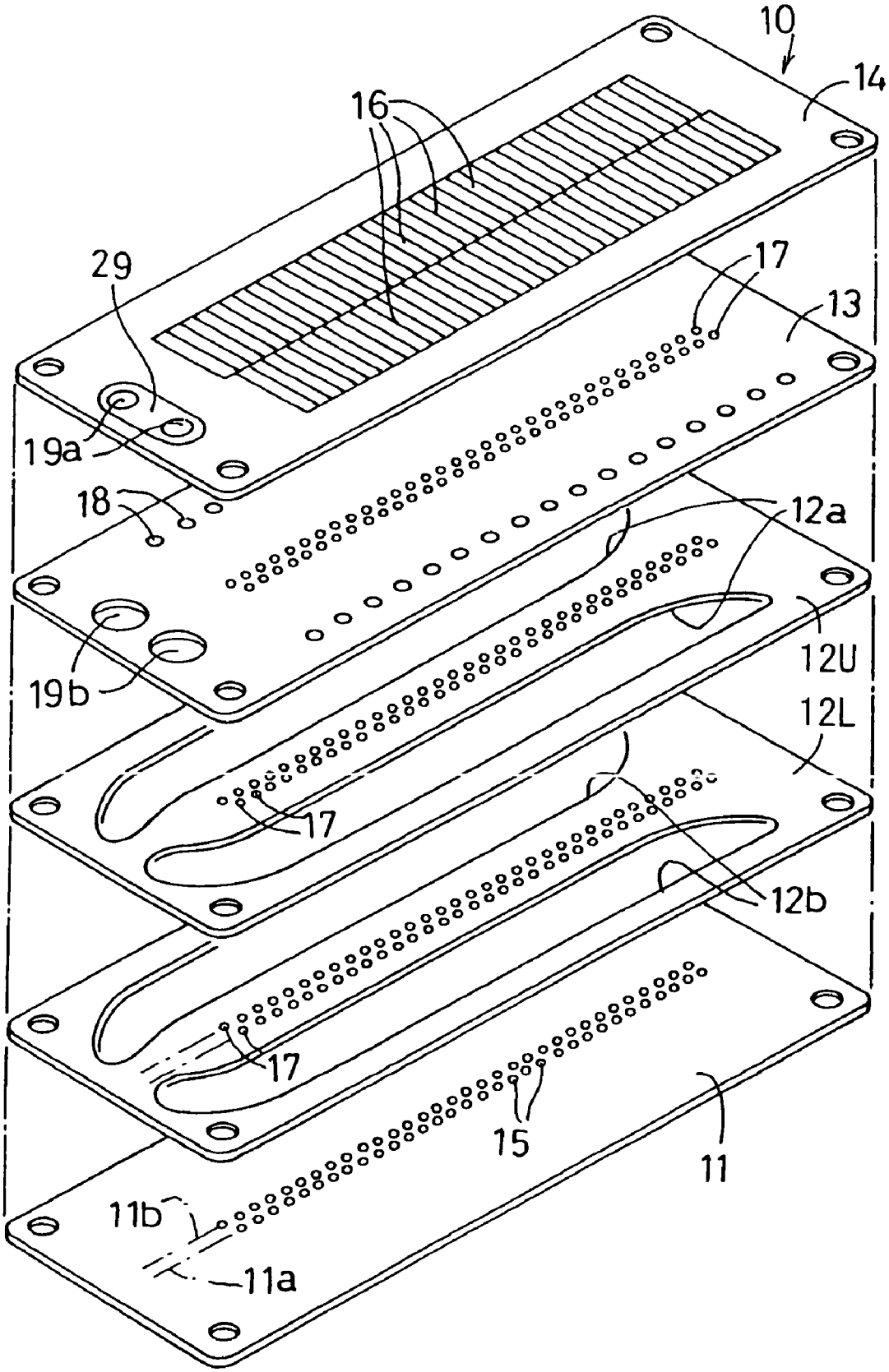
FIG. 14 is an exploded perspective view of the cavity plate.

As shown in FIG. 14, at one end of the base plate 14, supply holes 19*a* are provided so as to supply ink from an ink tank disposed above the base plate 14. A filter 29 is bonded over the supply holes 19*a*, using an adhesive, so as to remove foreign matter from the ink. As shown in FIG. 6A, the filter 29 has meshed portions 29*a* to be aligned with the supply holes 19*a*. The ink passes through the meshed portions 29*a* and foreign matter contained in the ink is caught there.

As shown in FIG. 14, at one end of the spacer plate 13, supply holes 19*b* are provided through the spacer plate 13 so as to communicate with the supply holes 19*a*. The supply holes 19*b* are positioned so as to be aligned with and communicate with end portions of the ink passages 12*a*, 12*b*.

Accordingly, ink fed from the supply holes 19*a*, 19*b* flows to the ink passages 12*a*, 12*b* and passes through each of the through holes 18, thereby to be directed to each of the pressure chambers 16. After that, the ink passes through each of the through holes 17 aligned with each of the end passages 16*a* of the pressure chambers 16 and reaches an associated one of the nozzle through holes 15.

Figure 16:
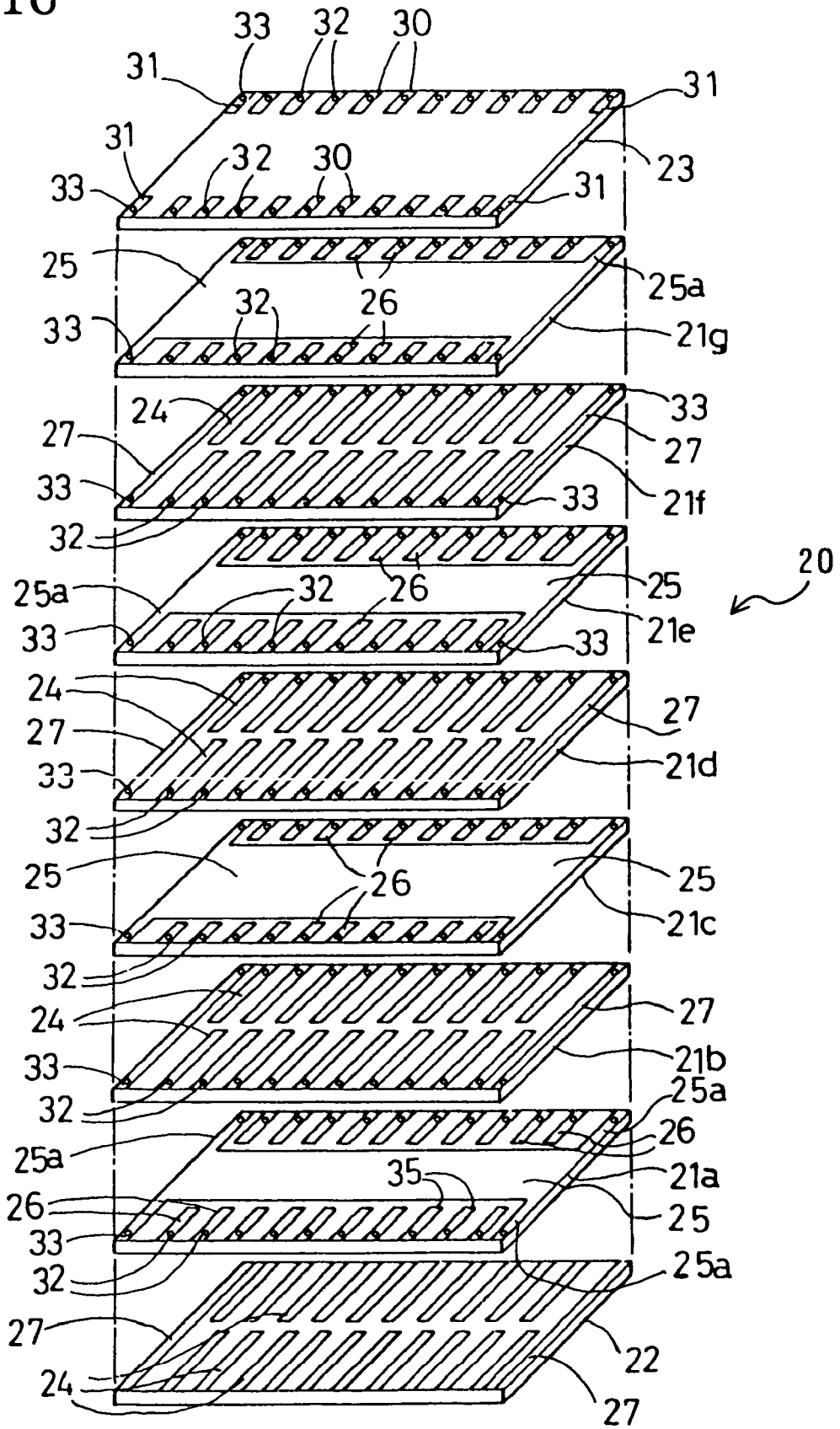
FIG. 16 is an exploded perspective view of the piezoelectric actuator.

As shown in FIG. 16, the piezoelectric actuator 20 is constructed by laminating nine piezoelectric sheets 21*a*, 21*b*, 21*c*, 21*d*, 21*e*, 21*f*, 21*g*, 22, 23. On the upper surface of the lowermost piezoelectric sheet 22 and on the upper side of piezoelectric sheets 21*b*, 21*d*, 21*f* from the bottom, individual electrodes 24 are formed in rows along the longitudinal direction so as to be aligned with the respective pressure chambers 16 in the cavity plate 10. On the piezoelectric sheets 21*b*, 21*d*, 21*f*, the individual narrow electrodes 24 extend laterally to the longitudinal direction and terminate close to the longitudinal edges of the sheets 21*b*, 21*d*, 21*f*. On the upper surface of piezoelectric sheets 21*a*, 21*c*, 21*e*, 21*g* from the bottom, a common electrode 25 is formed so as to be aligned with the pressure chambers 16.

Each of the individual electrodes 24 is designed to be slightly smaller in width than the associated pressure chamber 16.

The pressure chambers 16 are generally centered in the shorter side direction and arranged in two rows along the longitudinal direction. In order to cover the two-row pressure chambers, the common electrode 25 in each of piezoelectric sheets 21*a*, 21*c*, 21*e*, 21*g* is formed into a rectangular shape centered in the shorter direction and extending in the longitudinal direction. In addition, near the lateral edges of each of piezoelectric sheets 21*a*, 21*c*, 21*e*, 21*g*, lead portions 25*a* are integrally formed with the common electrode 25 so as to extend throughout the lateral edges.

On the upper surface of each of piezoelectric sheets 21*a*, 21*c*, 21*e*, 21*g*, dummy individual electrodes 26 are formed at positions along the longitudinal edges outside the common electrode 25. The dummy individual electrodes 26 are aligned with the individual electrodes 24, and have a substantially equal width and a shorter length, compared with the individual electrodes 24.

On the upper surface of the piezoelectric sheet 22 at the bottom and on the upper surface of each of piezoelectric sheets 21*b*, 21*d*, 21*f*, dummy common electrodes 27 are formed near the shorter side edges throughout their length in alignment with the contiguous lead portions 25*a*, 25*a*.

On the upper surface of the top sheet 23 at the top, surface electrodes 30 are provided along the longitudinal edges so as to be aligned with the respective individual electrodes 24. In addition, at the four corners of the upper surface of the top sheet 23, surface electrodes 31 are provided so as to be aligned with the lead portions 25*a* of the common electrode 25.

In the piezoelectric sheets 21*a*, 21*b*, 21*c*, 21*d*, 21*e*, 21*f*, 21*g* and the top sheet 23 through holes 32 are formed such that the surface electrodes 30 communicate with the aligned individual electrodes 24 and dummy individual electrodes 26. Similarly, through holes 33 are formed at the four corners such that the surface electrodes 31 of the top sheet 23 communicate with the aligned lead portions 25*a* of each common electrode 25, and the aligned dummy common electrodes 27.

By filling the through holes 32, 33 with a conductive material, the individual electrodes 24, the dummy individual electrodes 26, and the surface electrodes 30, which are aligned with each other in the laminating direction, are electrically connected. Likewise, the common electrodes 25, the dummy common electrodes 27, and the surface electrodes 31 on the top sheet 23, which are aligned with each other, are electrically connected.

The piezoelectric actuator 20 is fabricated by the following method.

A plurality of ceramic sheets, each of which is as large as a plurality of piezoelectric sheets 21*a*–21*g*, 22 arranged in a matrix from, should be prepared. A plurality of piezoelectric sheets are fabricated from a single ceramic sheet. The piezoelectric sheets 21*b*, 21*d*, 21*f*, 22 are fabricated in the same way because individual electrodes 24 and dummy common electrodes 27 are formed in the same positions thereon. However, the piezoelectric sheet 22 is exceptional in that no through holes 32, 33 are formed therein.

First, through holes 32, 33 are formed in three ceramic sheets, which will be the piezoelectric sheets 21*b*, 21*d*, 21*f*. No through holes need to be formed in a ceramic sheet, which will be the piezoelectric sheet 22.

Then, individual electrodes 24 and dummy common electrodes 27 are formed on the above four ceramic sheets by screen-printing using a well-known conductive paste. The conductive paste is placed at positions where the individual electrodes 24 and the dummy common electrodes 27 are formed, and is also filled into the through holes 32, 33.

Also, through holes 32, 33 are formed in four ceramic sheets, which will be the piezoelectric sheets 21*a*, 21*c*, 21*e*, 21*g*.

Then, common electrodes 25 and dummy individual electrodes 26 are formed on the above four ceramic sheets by screen-printing using a well-known conductive paste.

Then, through holes 32, 33 are also formed in a ceramic sheet corresponding to the top sheet 23. Surface electrodes 31 are formed on the ceramic sheet by screen-printing using a well-known conductive paste.

The ceramic sheets obtained in this way are sufficiently dried and laminated in the order shown in FIG. 16. The laminated ceramic sheets are pressed in the laminating direction into a single laminated body. The laminated body is baked and then cut into piezoelectric actuators 20.

In each of the piezoelectric actuators 20 obtained as described above, the individual electrodes 24 and the dummy individual electrodes 26 provided on the vertically laminated piezoelectric sheets 21*a*–21*g* and the surface electrodes 30 provided on the top surface 23 are vertically aligned and electrically connected with each other, by means of the through holes 32 formed in each of the piezoelectric sheets 21*a*–21*g*, and the top sheet 23. Similarly, the common electrodes 25 and the dummy common electrodes 27 provided on the piezoelectric sheets 21*b*, 21*d*, 21*f* and 22 and the surface electrodes 31 provided on the top sheet 23 are vertically aligned and electrically connected with each other by means of the through holes 33 formed in each of the piezoelectric sheets 21*a*–21*g* and the top sheet 23.

In addition, as shown in FIG. 17, an adhesive sheet 41 made of an ink-impermeable synthetic resin is bonded entirely to the lower surface of the piezoelectric actuator 20, that is, the lower surface of the piezoelectric sheet 22. Then, the piezoelectric actuator 20 is bonded to the cavity plate 10 such that the individual electrodes 24 in the piezoelectric actuator 20 are aligned with the respective pressure chambers 16. Consequently, the adhesive sheet 41 is bonded to the base plate 14 of the cavity plate 10 at portions other than the pressure chambers 16, thereby securing the piezoelectric actuator 20 to the cavity plate 10.

In addition, a flexible flat cable 40 is pressed onto the upper surface of the piezoelectric actuator 20, that is, onto the upper surface of the top sheet 23, and various wiring patterns (not shown) are electrically connected to each of the surface electrodes 30, 31.

Fabrication of the ink-jet head 1 is now completed.

An ink-impermeable and electrically insulative material should be used for the adhesive sheet 41. More specifically, it is preferable to use a film of polyamide hotmelt adhesive mainly composed of a nylon base or dimer-acid base polyamide resin, or a film of polyester base hotmelt adhesive. Alternatively, the piezoelectric sheet 22 may be bonded to the cavity plate 10 by applying first a polyolefin base hotmelt adhesive to the lower surface of the piezoelectric sheet 22. The thickness of the adhesive layer is preferably about 1 μm.

In order to eject ink from the ink-jet head 1, an electric potential is applied, through the flat cable 40, to the surface electrodes 30 associated with the nozzles from which ink is to be ejected to cause a potential difference between the surface electrodes 30 and the surface electrodes 31. This causes a potential difference between the individual electrodes 24 aligned with the above surface electrodes 30 and the common electrodes 25. Then, portions of the piezoelectric sheets 21 associated with the above individual electrodes 24 deform in the laminated direction so as to increase the volume of the associated pressure chambers 16, thereby causing ink to flow into these pressure chambers 16. The ink flows from the ink passages 12*a*, 12*b* provided in the manifold plates 12U, 12L, respectively, to store the ink supplied from the holes 19*a*, 19*b*. When the electric potential applied to the surface electrodes 30 is cancelled, the deformed piezoelectric sheets 21 return to their original state, and the volume of the associated pressure chambers 16 is reduced. Due to the pressure applied to these pressure chambers 16 when their volume is reduced, ink is ejected from the associated nozzles 54 through the associated through holes 17.

The construction and the fabricating method of the cavity plate 10 and the piezoelectric actuator 20 are disclosed in detail in the U.S. Patent Application entitled PIEZOELECTRIC INK-JET PRINTER HEAD AND METHOD OF FABRICATING SAME.

As shown in FIGS. 2 and 3, a cover plate 44 made of a resilient thin metal plate is bonded, using an adhesive, to the lower surfaces of the head units 6. The cover plate 44 has, at its central portion, openings 44*a* through which the nozzles 54 are exposed and, at its both ends, bends 44*b*, 44*c* which extend from the underside of a bottom plate 5 and along the side faces of a frame 1. The bend 44*b* at one end of the cover plate 44 covers half the undersides of the flexible flat cables 40. A gap between the edges of the openings 44*a* in the cover plate 44 and the lower surfaces of the head units 6 is sealed with an adhesive for bonding the cover plate 44 and the head units 6. Thus, dust is prevented from entering therebetween.

Bonding the head unit 6 to the bottom plate 5 of the frame 1 will now be described.

Figure 18:
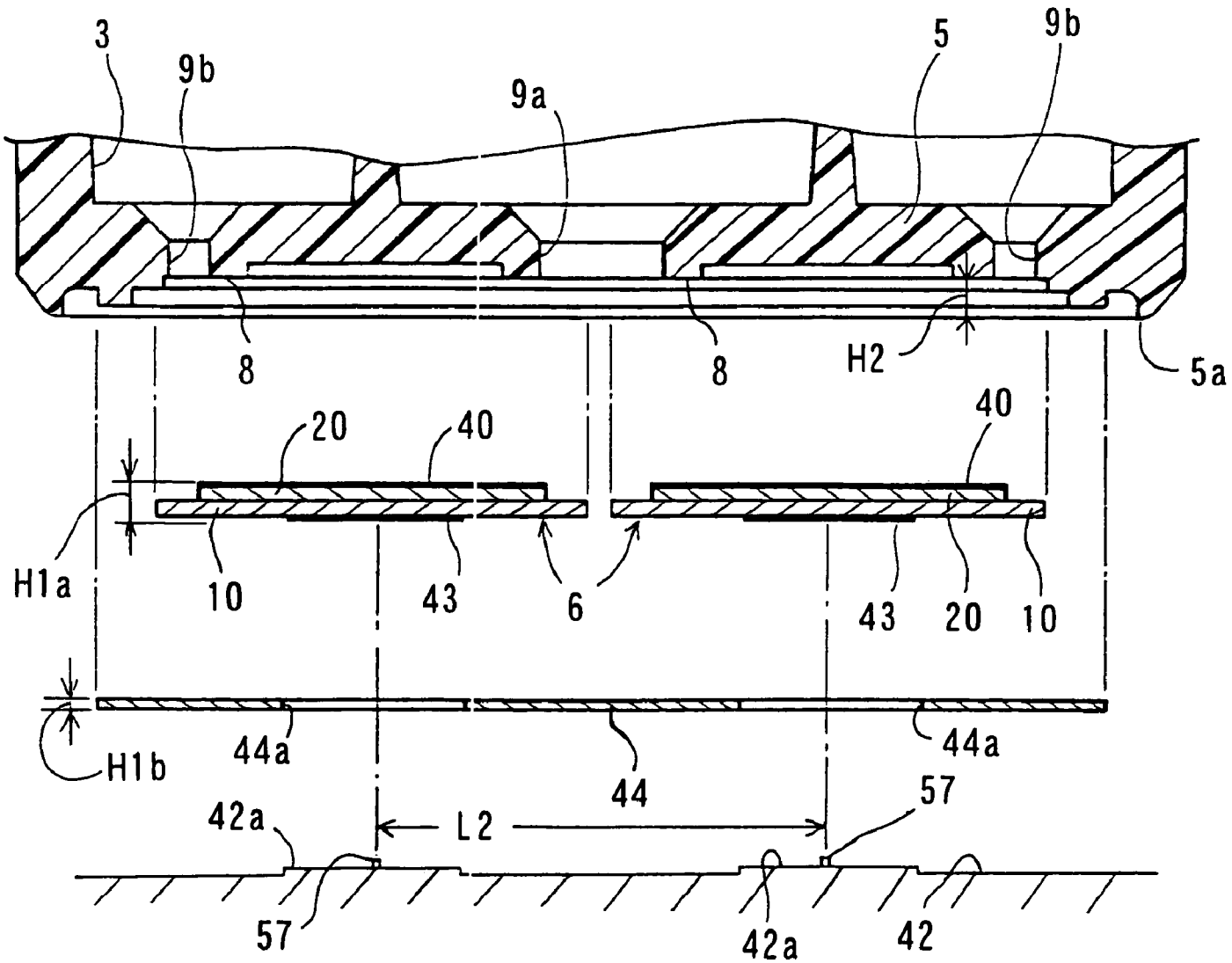
FIG. 18 is an enlarged cross-sectional view taken along line IX—IX of FIG. 4.

As shown in FIGS. 18 and 19, the cover plate 44 is placed upside down on a jig 42. Prior to that, four positioning pins 57 should be provided on the jig 42. The two nozzle plates 43 should be accurately positioned such that the rows of the nozzles 54 therein become parallel to each other. First, the two positioning pins 57, 57 are provided at the front and rear of the jig 42 so as to be aligned with the positioning holes 55, 55, which are formed at the front and rear of each of the nozzle plates 43 and spaced a distance L1 away from each other. In addition, the positioning pins 57, 57 are spaced a distance L2 away from each other so as to keep the rows of the nozzles 54 in the two nozzle plates 43 parallel to each other.

Peripheral portions 42*a* around the positioning pins 57, 57 in the jig 42 project higher than the rest and make contact with the nozzle plates 43. The peripheral portions 42*a* are smaller than the openings 44*a* of the cover plate 44.

The cover plate 44 is placed on the jig 42 such that the peripheral portions 42*a* are inserted into the openings 44*a*.

Figure 7A:
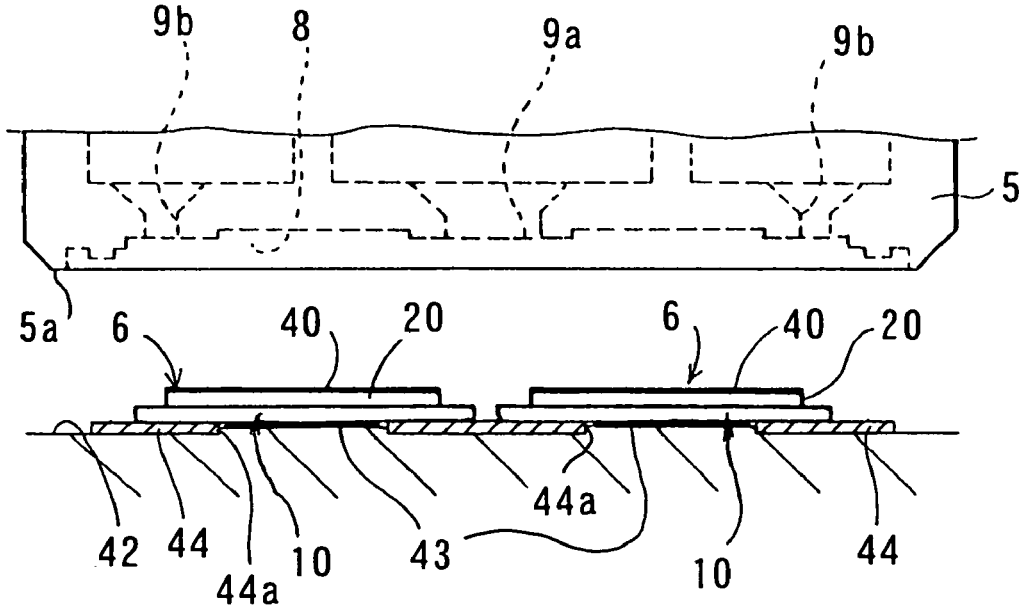
FIG. 7A is a side view showing the head unit positioned above a jig.

After that, the nozzle plates 43 of the head unit 6 are aligned with the peripheral portions 42*a* of the plate-like jig 42, and the positioning holes 55 provided in each of the nozzle plates 43 are mated with the corresponding positioning pins 57. When the positioning holes 55 of the two head units 6 are mated with the corresponding positioning pins 57 in the same manner, two sets of rows of nozzles 54 become parallel to each other without any displacements at their front and rear, and the nozzle plates 43 are exposed through the openings 44*a* (FIG 7A).

The height of the positioning pin 57 may be greater than the thickness of the nozzle plate 43. As the escape holes 56 are formed in the lower plate 11 contiguous to the nozzle plate 43 and the manifold plate 12L, the tip of each of the positioning pins 57 may be high enough to locate within the corresponding escape hole 56, as shown in FIG. 8.

When the positioning pins 57 are equal, in diameter, to the positioning holes 55, the positioning pins 57 do not rattle in the positioning holes 55. Accordingly, the lower surfaces of the nozzle plates 43 are kept in contact with the peripheral portions 42*a* of the jig 42, and the direction of the ink ejected from the nozzles 54 can be set accurately perpendicular to the surface of the jig 42.

On the other hand, when the positioning pins 57 are smaller, in diameter, than the positioning holes 55, the positioning pins 57 can be inserted into the positioning holes 55 and the escape holes 56 regardless of a slight horizontal positioning error introduced when the plates 43, 11, 12U, 12L, 13, 14 are laminated.

When the positioning holes 55 are mated with the corresponding positioning pins 57, an adhesive is placed between the two head units 6, 6 and the cover plate 44 to bond them together. The adhesive is not required to be hardened instantaneously and may be hardened gradually to secure the head units 6, 6 to the cover plate 44.

Figure 7B:
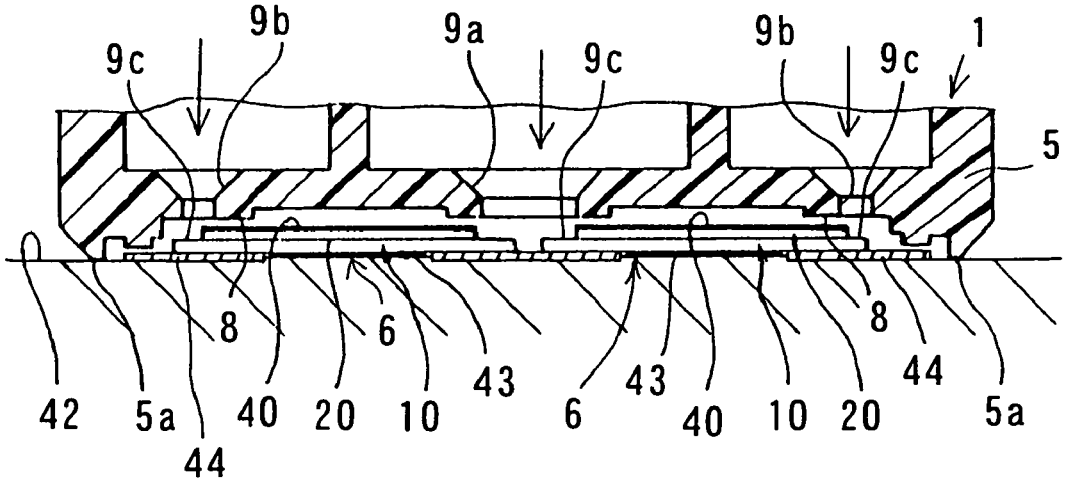
FIG. 7B is a cross-sectional view showing the head unit overlaid on the frame.

Then, as shown in FIG. 6A, the ring-shaped packing 47 made of soft rubber is pushed into each of the annular grooves 46 so as to project about ½–⅓ of its height from the support 8. In such a state, a silicone resin sealant 48 is filled into each of the annular grooves 46. Then, as shown in FIGS. 7A and 7B, the frame 1 is placed over the head units 6 with the supports 8 facing downward. Because the supports 8 are stepped down from the bottom plate 5, the head units 6 are set in the stepped down portions. Consequently, as shown in FIG. 9, the edges of ribs 5*a* of the bottom plate 5 become flush with the lower surface of the cover plate 44.

Figure 6B:
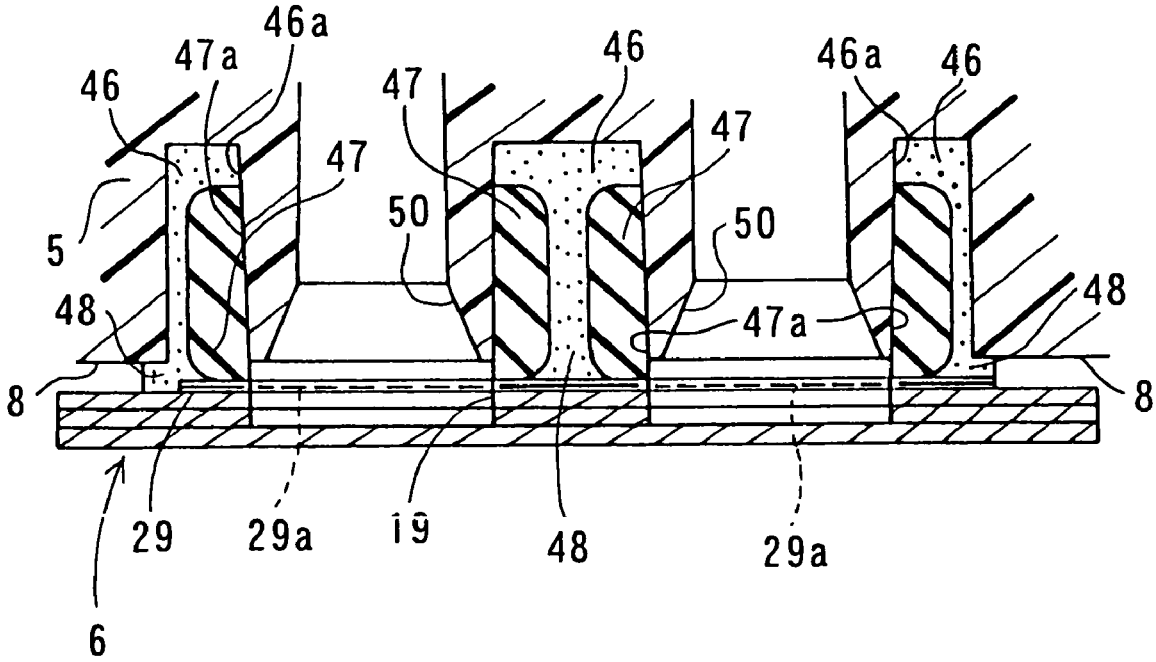
FIG. 6B illustrates a state where a head unit is pressed against the packings to seal against ink leakage.

At this time, as shown in FIG. 6B, each of the packings 47 is brought into contact, at its end, with the periphery of a meshed portion 29*a* (ink supply hole 19*a*) of a filter 29 provided to each of the head units 6. The sealant 48 remains within each of the annular grooves 46 due to its viscosity.

As shown in FIG. 6B, when at least one of the head units 6 and the frame 1 is pressed relative to each other, each of the packings sinks into the annular groove 46 while the end of the packing is kept in intimate contact with the filter 29 so as to surround the ink supply hole 19*a* and while the inner rim face 47*a* of the packing 47 is kept in intimate contact with the inner rim wall 46*a* of the annular groove 6. As a result, the sealant 48 within the annular groove 46 overflows the packing 47. However, the end of packing 47 is kept in intimate contact with the periphery of the meshed portion 29*a* of the filter 29. Thus, the overflowing sealant 48 is prevented from entering the inside diameter portion of the packing 47 and makes intimate contact, in the outer rim of the packing 47, with the head unit 6 to securely seal the meshed portion 29*a* and the supply hole 19*a*.

As described above, the sealant 48 can be distributed where it is needed simply by pressing the head unit 6 and the frame 1 relative to each other.

Accordingly, because each of the supply holes 19*a* is doubly sealed by the packing 47 and the sealant 48 around thereof, no ink leaks from the vicinity of the supply hole 19*a*. When inks of different colors are supplied to the supply holes 19*a*, they are not mixed with each other.

In addition, the ink flowing from the aperture 50 to the supply hole 19*a* is completely isolated from the sealant 48 by the packing 47. This prevents chemical reaction between the ink and the sealant 48 and, as a result, no foreign particles are generated and the sealing performance is not deteriorated due to erosion of the sealant 48 by the ink.

Then, as shown by the arrows in FIG. 7B, a denatured acrylic resin base viscosity UV adhesive 7 is filled into the recesses 9*a*, 9*b* from the upper side of the frame 1. This UV adhesive 7 is hardened shortly within several tens of seconds under ultraviolet irradiation. Accordingly, the recesses 9*a*, 9*b* filled with the UV adhesive 7, if exposed to ultraviolet light, is hardened in a short time to bond the frame 1 and the head units 6.

As shown in FIG. 18, it is preferable that H2 is slightly thicker than H1*a*+H1*b*, where H1*a* is the overall thickness from the nozzle plate 43 to the flexible flat cable 40, H1*b* is the thickness of the cover plate 44, and H2 is the depth from the rib 5*a* formed in the bottom plate 5 to the support 8.

With this construction, as shown in FIG. 7B, a slight gap 9*c* is created between the supports 8 and the flexible flat cables 40, piezoelectric actuators 20, and cavity plates 10. The UV adhesive 7 is hardened in a short time while entering the gap 9*c*. Thus, the frame 1 and the head units 6 are bonded to each other without being pressed against each other, that is, without an external load exerted on the both of them. Accordingly, when the frame 1 and the head units 6 are bonded to each other, the nozzles 54 are not displaced from their specified positions, and the fabricating accuracy is improved.

In addition, as described above, the recesses 9*a*, 9*b* provided near the four corners of each of the head units 6 can minimize displacement of the head unit 6 caused by contractionary distortion of the UV adhesive 7 when it is hardened. As a result, an ink-jet head with a high degree of accuracy can be fabricated.

The UV adhesive 7 filled near the four corners of the head unit 6 allows the head unit 6 to be evenly bonded to the frame 1. In an ink-jet head mounted on a printer, a restoration operation is occasionally performed by moving a cap into intimate contact with all the nozzles 54 in order to suck foreign matter from the nozzles 54. The surface of the cavity plate 10 should be pressed hard enough when the cap is moved into intimate contact with the nozzle through holes 15. In this case, because the head unit 6 is evenly bonded to frame 1, the cavity plate 10 is unlikely to be distorted and thus ink ejection will not be adversely affected.

Further, as shown in FIG. 4, each of the wide recesses 9*a* extends over the adjacent sides of the head units 6, 6 arranged side by side. Thus, by filling the UV adhesive 7 into one recess 9*a* and by irradiating the recess 9*a* with ultraviolet light, two head units 6, 6 can be bonded to the frame 1 at a time. This will reduce the process speed and substantially improve the fabricating efficiency.

In addition, by filling the UV adhesive 7 into all the recesses 9*a*, 9*b* and by irradiating all the recesses 9*a*, 9*b* with ultraviolet light, the UV adhesive 7 in all the recesses 9*a*, 9*b* can be simultaneously hardened and thus the bonding accuracy can be improved.

As a quickly hardened adhesive, a moisture-hardened adhesive, which is similar, in components, to the UV adhesive 7, can be used.

Figure 10:
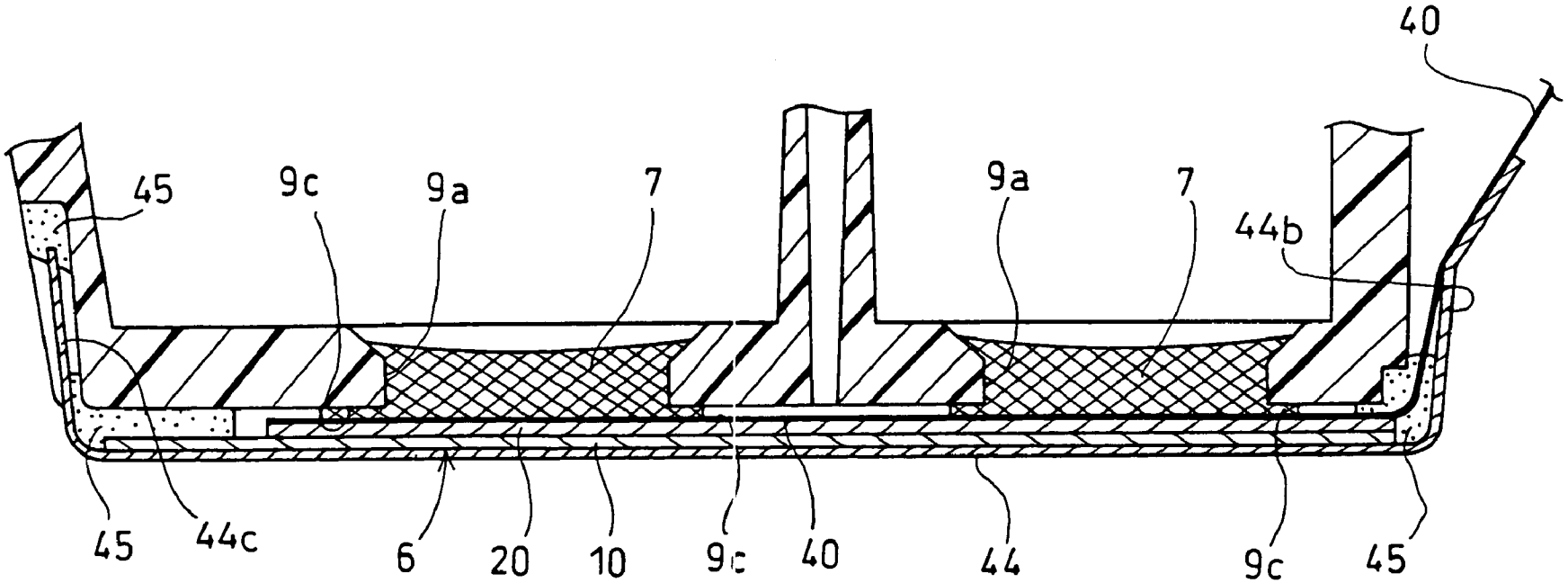
FIG. 10 is a cross-sectional view, taken along line X—X of FIG. 4, showing bonding between the frame and the head unit.
Figure 11:
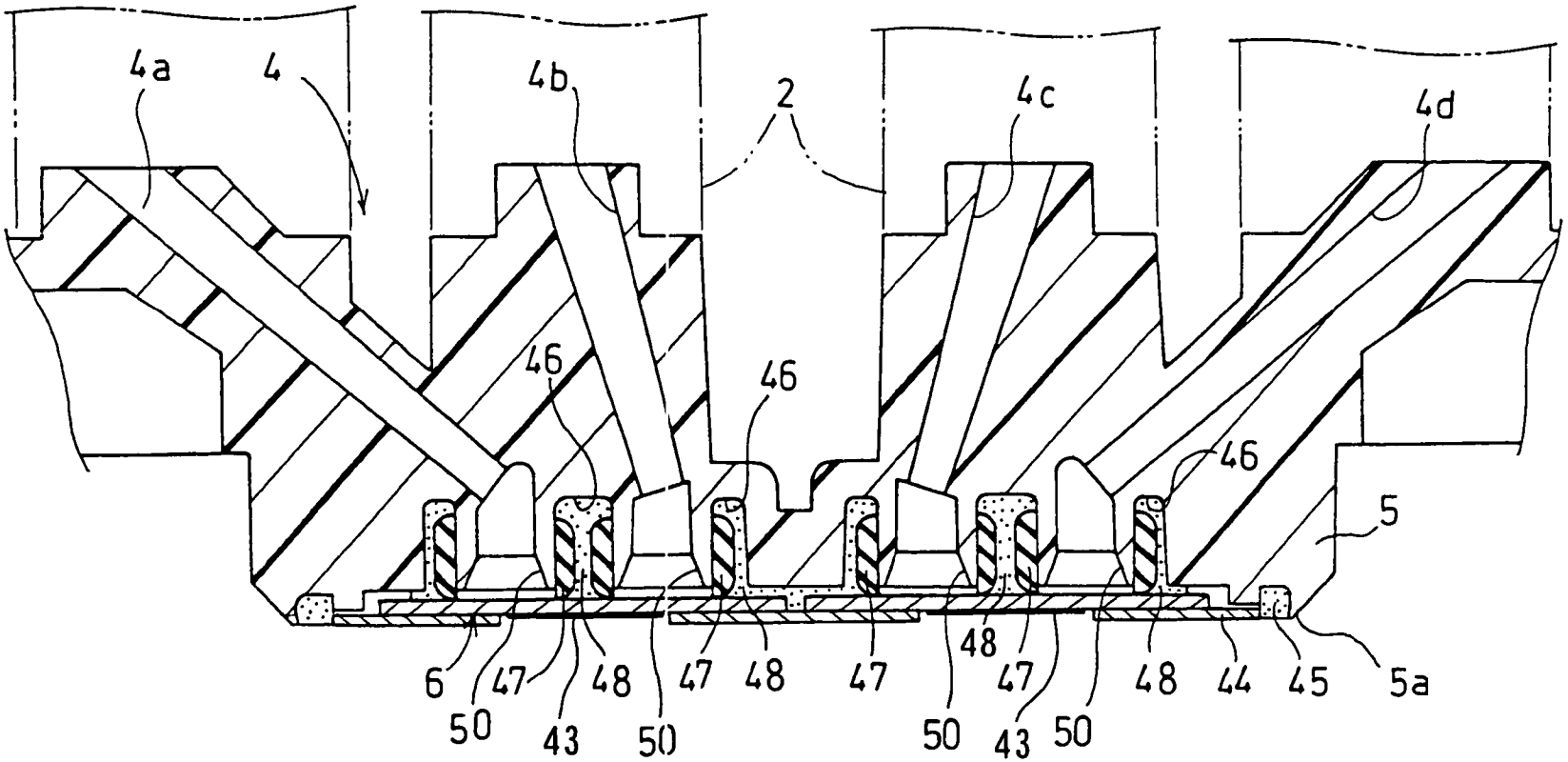
FIG. 11 is a cross-sectional view showing sealing between apertures and supply holes.
Figure 12:
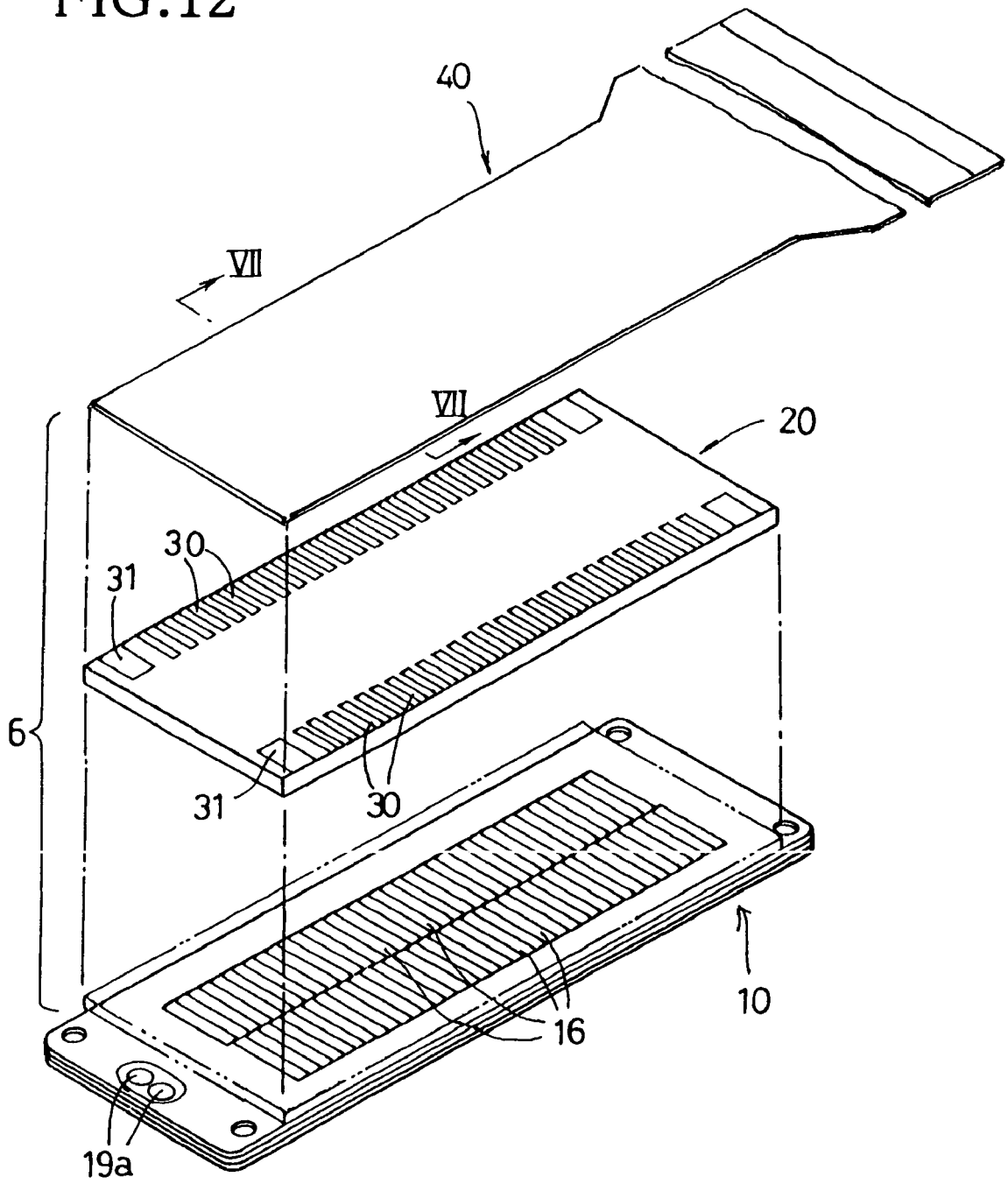
FIG. 12 is perspective view of components of the head unit.

After that, as shown in FIGS. 9–11, a sealant 45 is applied between the edges on both sides of the cover plate 44 and the ribs 5*a*, and between the tip of the bend 44*c* in the cover plate 44 and the side face of the frame 1. It is noted that before the frame 1 is placed over the head units 6, a sealant 45 is applied between the flexible flat cables 40 and the frame 1, between the flexible flat cables 40 and the cover plate 44, and between the corner of the bend 44*c* of the cover plate 44 and the frame 1.

More specifically, as shown in FIGS. 9–11, the periphery of the cover plate 44 is sealed from the frame 1 using the sealant 45, which is a silicone adhesive. As best shown in FIGS. 10 and 11, the sealant 45 is filled generally in a U-shaped manner between the edges on both sides of the cover plate 44 and the ribs 5*a* projecting upward on both sides of the bottom plate 5, and between the tip of the bend 44*c* of the cover plate 44 and the side face of the frame 1. In addition, the previously applied sealant 45 is filled between the inner face of the bend 44*b* and the flexible flat cables 40 and between the flexible flat cables 40 and the side face of the frame 1.

As described above, spaces between the two head units 6 are sealed by the cover plate 44, and spaces between the frame 1 and the periphery of the head units 6 are sealed by the cover plate 44 and the sealant 45. Thus, no ink, paper dust, or dirt can enter the gap 9*c* between the frame 1 and the head units 6. This prevents a short circuit in contacts between the piezoelectric actuators 20 and the flexible flat cables 40. In addition, the bend 44*b* protects the flexible flat cables 40 while leading them in the proper direction.

Then, the jig 42 is removed from the cover plate 43 and the positioning pins 47 are released from the positioning holes 55. Fabrication of an ink-jet head is now completed. The jig 42 is kept in engagement until the completion of the ink-jet head permits the nozzle plates 43 to be kept in the same positions during the above-described series of processes and prevents the orientation of the nozzles 54 from deviating.

An external view of the ink-jet printer fabricated as described above is shown in FIG. 1. The frame 1 is mounted on a carriage (not shown) to reciprocate along the printing medium. The flexible cables 40 are connected to a driving circuit (not shown).

Although, in the above-described embodiment, the two head units 6 are arranged side by side, the number of head units may be arbitrarily set depending on the usage of a ink-jet printer.

The cavity plate 10 of the head unit 6 can be made of ceramic, instead of metal.

Instead of using the piezoelectric actuator 20, an alternative configuration may be used where an oscillation plate covering the back of pressure chambers is oscillated by static electricity to cause ink ejection from the nozzles 54.

Instead of using the ink cartridges mounted on the frame 1, ink may be supplied to the ink supply passages 4*a*–4*b* through a tube from an ink tank located away from the carriage.

As the sealants 48, 45, agents having not only sealing but also bonding properties may be used.

The annular groove 46 may be provided one by one for each of the apertures 50.

When ink of the same color is supplied from a plurality of adjacent supply holes 19*a*, 19*a*, an oval annular groove may be formed so as to collectively surround the corresponding apertures 50, 50, and the apertures 50, 50 may be sealed by a common oval packing fitted into the oval annular groove.

Further, the inner rim wall 46*a* of the annular groove 46 may be formed with a taper diminishing from its open end to bottom.

While the invention has been described with reference to specific embodiments, the description of the specific embodiments is illustrative only and is not to be construed as limiting the scope of the invention. Various other modifications and changes may occur to those skilled in the art without departing from the spirit and scope of the invention.

What is claimed is:

1. An ink-jet printer head, comprising:

at least one head unit, each of which includes a first surface where at least one nozzle is provided, a second surface opposite to the first surface, and at least one ink supply hole communicating with the at least one nozzle;

a frame including a support where the second surface of each of the at least one head unit is supported, an aperture in the frame disposed such that the second surface of each of the at least one head unit is exposed therethrough, and at least one ink supply passage, an ink supply passage communicating with each of the at least one ink supply hole; and an adhesive applied at the aperture to bond the second surface to the support, the adhesive being quickly hardened.

2. The ink-jet printer head as claimed in claim 1, wherein the adhesive is hardened under ultraviolet irradiation.

3. The ink-jet printer head as claimed in claim 2, wherein the adhesive is a denatured acrylic base viscosity ultraviolet adhesive.

4. The ink-jet printer head as claimed in claim 2, wherein the second surface of the at least one head unit is positioned on the frame so that the adhesive and the ultraviolet irradiation pass through the aperture.

5. The ink-jet printer head as claimed in claim 1, further comprising a cover plate attached at the first surface of the at least one head unit so that the at least one head unit is disposed between the frame and the cover plate.

6. The ink-jet printer head as claimed in claim 1, further comprising a bottom plate in the frame, the bottom plate including a third surface facing the second surface of the at least one head unit and a fourth surface opposite with the third surface, the bottom plate having a plurality of apertures that penetrate the bottom plate, each of the at least one ink supply passage communicating with each of the at least one ink supply hole of the at least one head unit.

7. The ink-jet printer head as claimed in claim 6, wherein the adhesive is applied between the second surface of the at least one head unit and the third surface of the bottom plate through the plurality of apertures, each of the plurality of apertures facing a peripheral portion of the at least one head unit such that the peripheral portion of the at least one head unit is exposed through the plurality of apertures.

8. The ink-jet printer head as claimed in claim 6, wherein a rib is formed in the bottom plate, an edge of the rib is flush with a surface of a cover plate so as to form a gap between the at least one head unit and the frame.

9. The ink-jet printer head as claimed in claim 6, wherein the bottom plate is stepped down from the frame so as to project therefrom.

10. The ink-jet printer head as claimed in claim 1, further comprising a nozzle plate on the first surface on the at least one head unit, and a flexible flat cable on the second surface of the at least one head unit.

11. The ink-jet printer head as claimed in claim 10, wherein a depth from a rib formed in a bottom plate to the support is larger than the overall depth from the nozzle plate to the flexible flat cable.

12. The ink-jet printer head according to claim 1, further comprising:

a plurality of head units;

wherein a plurality of supports are formed at a third surface of a bottom plate side by side, each of the plurality of supports are formed at the third surface of the bottom plate side by side, each of the plurality of supports facing the second surface of each of the plurality of head units, and the second surface of each of the plurality of head units is exposed through the plurality of apertures.

13. The ink-jet printer head as claimed in claim 12, further comprising a cover plate attached at the first surface of the plurality of head units so that the plurality of head units are disposed between the frame and the cover plate.

14. The ink-jet printer head as claimed in claim 12, further comprising a common aperture so that the second surfaces of two of the plurality of head units in a row are exposed therethrough, wherein the adhesive is applied at the common aperture so that the second surfaces of the two of the plurality of head units are simultaneously bonded to each one of the plurality of the supports.

15. The ink-jet printer head as claimed in claim 12, wherein each one of the plurality of head units has a plurality of corners; and each one of the plurality of apertures is disposed about each one of the plurality of corners.

16. The ink-jet printer head as claimed in claim 1, wherein the at least one head unit further comprises a nozzle plate having a plurality of positioning holes, each one of the plurality of positioning holes corresponding to each of a plurality of positioning pins on a jig.

17. The ink-jet printer head as claimed in claim 16, wherein the at least one head unit further comprises a cavity plate attached to the nozzle plate face by face, the cavity plate having a plurality of escape holes corresponding to each one of the plurality of positioning holes, a diameter of each one of the plurality of escape holes being larger than a diameter of each one of the plurality of positioning holes.

18. The ink-jet printer head as claimed in claim 1, further comprising:

a plurality of apertures, each one of which exposes each one of a portion of the second surface of the at least one head unit, wherein the adhesive is applied at each one of the plurality of recesses.

19. a method of bonding a head unit to a frame, comprising:

providing at least one head unit having a plurality of positioning holes, each of the at least one head unit having a first surface and a second surface opposite with the first surface;

providing a bottom plate at the frame, the bottom plate having a third surface and a fourth surface opposite with the third surface, the bottom plate being formed with a plurality of recesses each of which penetrates the bottom plate;

providing a jig having a plurality of positioning pins;

providing a cover plate having a plurality of openings;

disposing the cover plate on the jig;

disposing the at least one head unit on the jig in a manner that each of the plurality of positioning pins is inserted into a corresponding one of the plurality of positioning holes and that the first surface of each of the at least one head unit exposes through a corresponding one of the plurality of openings;

disposing the frame onto the jig in a manner that the third surface of the bottom plate faces the second surface of the at least one head unit and the second surface exposes through the plurality of recesses; and applying an adhesive between the second surface of the at least one head unit and the third surface of the bottom plate through the plurality of recesses without applying pressure.

20. The method as claimed in claim 19, wherein the height of the positioning pin is greater than the nozzle plate thickness.

21. The method as claimed in claim 19, further comprising disposing the frame onto the jig so that a gap is formed between the at least one head unit and the frame, and disposing each aperture at an edge of the at least one head unit.

22. The method as claimed in claim 21, wherein the adhesive is a denatured acrylic base viscosity ultraviolet adhesive.

23. The method as claimed in claim 19, wherein the cover plate further includes a first bend and a second bend and applying a sealant between the first bend and the frame and the second bend and the frame.

24. The method as claimed in claim 19, further comprising:

providing a plurality of head units, each one of the plurality of head units having a plurality of corners; and disposing each one of the plurality of apertures about each one of the plurality of corners.

25. The method as claimed in claim 24, further comprising:

disposing at least two of the plurality of head units side by side; and disposing each one of the plurality of apertures over a corresponding side of one of the plurality of head units.

26. The method as claimed on claim 24, further comprising:

filling each one of the plurality of apertures with an ultraviolet adhesive and irradiating the ultraviolet adhesive with ultraviolet light so that all the apertures are simultaneously hardened.

27. A method of manufacturing an ink-jet printer head, comprising:

providing at least one head unit, each of which includes a first surface where at least one nozzle is provided, a second surface opposite with the first surface, and at least one ink supply hole communicating with the at least one nozzle;

providing a frame including a bottom plate and at least one ink supply passage, the bottom plate including a third surface facing to the second surface of the at least one head unit and a fourth surface opposite with the third surface, the bottom plate having a plurality of apertures that penetrate the bottom plate, each of the at least one ink supply passage communicating with each of the at least one ink supply hole of the at least one head unit; and applying an adhesive between the second surface of the at least one head unit and the third surface of the bottom plate through the plurality of apertures, each of the plurality of apertures facing a peripheral portion of the at least one head unit such that the peripheral portion of the at least one head unit is exposed through the plurality of apertures.

28. The method as claimed in claim 27, further comprising attaching a cover plate at the first surface of the at least one head unit; wherein the frame is provided after the cover plate is attached to the at least one head unit so that the at least one head unit is disposed between the frame and the cover plate.

29. The method of manufacturing an ink-jet printer head as claimed in claim 27, wherein the adhesive is a hardened under ultraviolet irradiation.

30. The method as claimed in claim 29, wherein the adhesive is a denatured acrylic base viscosity ultraviolet adhesive.

31. The method as claimed in claim 27, wherein the frame further comprising:

a plurality of supports provided side by side; and a plurality of the apertures, each one of which corresponds to each one of the plurality of supports, wherein each one of the plurality of head units is provided at each one of the plurality of supports, and the second surface of each one of the plurality of head units is exposed through each one of the plurality of apertures.

32. The method as claimed in claim 31, further comprising:

attaching a cover plate at the first surface of the plurality of the head units so that the plurality of head units are disposed between the frame and the cover plate.

33. The method as claimed in claim 31, further comprising:

providing a common aperture on the frame so that the second surfaces of two of the plurality of head units in a row are exposed therethrough, wherein the adhesive is applied at the common aperture so that the second surfaces of the two of the plurality of head units are simultaneously bonded to each one of the plurality of the supports.

34. The method as claimed in claim 31, wherein each one of the plurality of head units has a plurality of corners; and each one of the plurality of apertures is disposed about each one of the plurality of corners.

35. The method as claimed in claim 27, wherein the at least one head unit further comprises a nozzle plate having a plurality of positioning holes, each one of the plurality of positioning holes corresponding to each of a plurality of positioning pins on a jig.

36. The method as claimed in claim 35, wherein the at least one head unit further comprises a cavity plate attached to the nozzle plate face by face, the cavity plate having a plurality of escape holes corresponding to each one of the plurality of positioning holes, a diameter of each one of the plurality of positioning holes, a diameter of each one of the plurality of escape holes being larger than a diameter of each one of the plurality of positioning holes.

37. The method as claimed in claim 35, wherein the nozzle plate includes at least one nozzle formed in a process to form the plurality of the positioning holes.

38. The method as claimed in claim 27, further comprising:

positioning a plurality of head units, wherein after the plurality of head units are positioned, the frame is provided such that the second surface of each one of the plurality of head units is supported at the support of the frame and the aperture of the frame is disposed in order that the second surface of each one of the plurality of head units is exposed therethrough, and the adhesive is applied at the aperture such that the plurality of the head units are bonded to the support.

39. The method as claimed in claim 37, further comprising:

providing a jig including a plurality of positioning pins, wherein each one of the plurality of head units includes a plurality of positioning holes, each one of the plurality of positioning holes corresponding to each one of the plurality of positioning pins, and wherein after the plurality of the head units are positioned at the jig in a manner that each one of the positioning pins is inserted into a corresponding one of the plurality of the positioning pins, the frame is provided such that the second surface of each one of the plurality of head units is supported at the support of the frame and the aperture of the frame is disposed in order that the second surface of each one of the plurality of head units is exposed therethrough.

40. The method as claimed in claim 39, further comprising:

providing a cover plate between the jig and the plurality of head units, wherein after the cover plate is placed on the jig, the plurality of the head units are positioned at the jig.

41. A method for bonding a head unit to a frame, comprising:

providing a plurality of head units, each having a first surface, a second surface opposite with the first surface, and a nozzle plate formed at the first surface having a plurality of nozzles;

providing the frame having a third surface;

disposing the plurality of head units in a manner that the nozzle plate of each of the plurality of head units is positioned in a common plane side by side;

disposing the frame in a manner that the third surface of the frame faces to the second surface of each of the plurality of head units; and applying an adhesive between the third surface of the frame and the second surface of each of the plurality of head units such that the plurality of head units are fixed side by side with the nozzle plate of each of the plurality of head units positioned in the common plane, wherein the frame includes a bottom plate having the third surface facing to the second surface of each of the plurality of head units and a fourth surface opposite with the third surface, the bottom plate having a plurality of apertures that penetrate the bottom plate such that the second surface of each of the plurality of head units is exposed through the plurality of apertures.

42. The method according to claim 41, wherein the adhesive is applied through the plurality of apertures from the second surface of each of the plurality of head units, and the adhesive is hardened under ultraviolet irradiation through the plurality of apertures.

* * * * *